US012538952B2

(12) United States Patent
Walsh et al.

(10) Patent No.: US 12,538,952 B2
(45) **Date of Patent: *Feb. 3, 2026**

(54) PERSONAL PROTECTIVE DEVICES WITH CARRYING BAGS

(71) Applicants: Timothy Walsh, Melville, NY (US); Kostyantyn Fedkin, Cape Town (ZA)

(72) Inventors: Timothy Walsh, Melville, NY (US); Kostyantyn Fedkin, Cape Town (ZA)

( * ) Notice: Subject to any disclaimer, the term of this patent is extended or adjusted under 35 U.S.C. 154(b) by 646 days.

This patent is subject to a terminal disclaimer.

(21) Appl. No.: 17/194,624

(22) Filed: Mar. 8, 2021

(65) Prior Publication Data

US 2021/0368893 A1 Dec. 2, 2021

Related U.S. Application Data

(63) Continuation of application No. 16/811,496, filed on Mar. 6, 2020, now Pat. No. 10,939,713.

(60) Provisional application No. 62/841,756, filed on May 1, 2019.

(51) Int. Cl.

| | |
|---|---|
| ***A41D 15/04*** | (2006.01) |
| ***A41D 13/05*** | (2006.01) |
| ***A41D 31/24*** | (2019.01) |
| ***A45C 9/00*** | (2006.01) |
| ***F41H 1/02*** | (2006.01) |

(52) U.S. Cl.

CPC ..... *A41D 15/04* (2013.01); *A41D 13/0518* (2013.01); *A41D 13/0587* (2013.01); *A41D 31/24* (2019.02); *A45C 9/00* (2013.01); *F41H 1/02* (2013.01)

(58) Field of Classification Search

CPC .... A41D 15/04; A41D 31/24; A41D 13/0518; A41D 13/0587; A45C 9/00

See application file for complete search history.

(56) References Cited

U.S. PATENT DOCUMENTS

| | | | |
|---|---|---|---|
| 4,412,495 | A | 11/1983 | Sankar |
| 4,475,247 | A | 10/1984 | Lee |

(Continued)

FOREIGN PATENT DOCUMENTS

| | | | |
|---|---|---|---|
| FR | 3032096 | A1 | 8/2016 |
| KR | 20070120264 | A | 12/2007 |

*Primary Examiner* — Alissa L Hoey

(74) *Attorney, Agent, or Firm* — Daniel P. Burke & Associates, PLLC; Daniel P. Burke

(57) ABSTRACT

Personal protective devices have a carrying bag, such as a purse, and a separate bullet resistant vest or penetration resistant (to stab wounds) vest comprises at least one neck sling and at least one torso strap. The bullet/penetration resistant vest is dimensioned to removably fit within the carrying bag. The carrying bags are configured to provide a "ready state" wherein a bullet resistant shield and neck sling are within the carrying bag while at least a connector attached to the end of a deployable torso strap(s) is outside of the carrying bag. The carrying bag has at least one slot designed to allow the torso strap(s) to be pre-fed from the interior of the carrying bag to a position exterior of the carrying bag. In this "ready state", the majority of the torso strap is maintained within the interior of the carrying bag. The neck sling and torso straps are deployable to secure the vest to a wearer's torso in the deployed position.

30 Claims, 20 Drawing Sheets

(56) References Cited

U.S. PATENT DOCUMENTS 4,546,863 A * 10/1985 Kaufman ..... F41H 5/08 220/900
4,830,245 A * 5/1989 Arakaki ..... F41H 5/08 2/2.5
5,031,733 A * 7/1991 Chang ..... A41D 15/04 2/2.5
5,245,706 A * 9/1993 Moschetti ..... A63B 71/12 2/45
5,724,672 A 3/1998 Chen
5,797,140 A * 8/1998 Davis ..... F41H 1/02 2/2.5
5,829,653 A * 11/1998 Kaiser ..... F41H 5/08 2/2.5
6,131,198 A 10/2000 Westrick
6,161,738 A * 12/2000 Norris ..... F41H 5/0457 383/119
6,336,222 B1 1/2002 Ware
6,419,132 B1 * 7/2002 Reed ..... A45C 15/00 2/2.5
6,460,746 B1 10/2002 Amram
6,685,071 B2 * 2/2004 Prather ..... F41H 5/08 2/2.5
7,160,028 B1 * 1/2007 Linday ..... A45C 9/00 150/108
7,418,739 B2 9/2008 Chan
7,441,278 B2 * 10/2008 Blakeley ..... F41H 1/02 2/205
9,027,810 B1 * 5/2015 Piersol ..... A45C 13/02 224/576
9,737,100 B2 * 8/2017 McIntire, Jr. ..... A41D 15/04
9,820,558 B1 * 11/2017 de Geus ..... F41H 1/02
9,861,145 B2 1/2018 McIntire
10,080,422 B2 9/2018 de Geus
10,098,441 B1 * 10/2018 Holloman ..... A45F 3/047
10,130,160 B1 * 11/2018 Cheng ..... A45F 4/02
10,182,640 B2 * 1/2019 Holtz ..... A45F 4/02
10,213,008 B2 * 2/2019 Weaver, Jr. ..... F41H 5/013
10,306,971 B2 * 6/2019 Zhang ..... A45F 3/04
10,314,384 B2 6/2019 de Geus
10,897,971 B2 * 1/2021 Taha ..... F41H 1/02
10,939,713 B2 * 3/2021 Walsh ..... A45C 3/02
11,353,291 B2 * 6/2022 Lander ..... A41D 15/04
2003/0132260 A1 7/2003 Prather
2005/0194413 A1 * 9/2005 Baker ..... A45C 3/14 224/153
2006/0011687 A1 1/2006 Wadley
2006/0153477 A1 * 7/2006 Koguchi ..... A45C 9/00 383/14
2006/0277669 A1 * 12/2006 Mott ..... A41D 13/0518 2/463
2007/0125815 A1 * 6/2007 Tong ..... A45F 4/02 224/583
2007/0266469 A1 11/2007 Blakeley
2007/0295772 A1 * 12/2007 Woodmansee ..... F41H 1/02 224/153
2009/0158510 A1 * 6/2009 Stinga ..... A41D 13/0518 2/463
2011/0079623 A1 4/2011 McCray-Clark
2012/0174279 A1 7/2012 Bailey
2012/0266344 A1 10/2012 Griffin
2015/0047940 A1 * 2/2015 Casas ..... A45C 5/02 190/127
2015/0196077 A1 7/2015 McIntire, Jr.
2016/0120280 A1 * 5/2016 Dingler ..... A45F 3/04 224/608
2017/0013948 A1 * 1/2017 Duthoit ..... A45F 3/06
2017/0276457 A1 * 9/2017 Chapman ..... A45F 4/02
2018/0295974 A1 * 10/2018 Zhang ..... A45C 7/0068
2018/0310698 A1 11/2018 Rao
2018/0317635 A1 * 11/2018 Quon-Chow ..... F41H 5/08
2019/0090620 A1 3/2019 Thomas
2019/0154405 A1 * 5/2019 Burnau ..... F41H 1/02
2019/0174903 A1 * 6/2019 Holder ..... A45F 3/06
2019/0208896 A1 7/2019 Schmidt
2019/0339044 A1 * 11/2019 Arranz ..... A45F 3/06
2019/0380478 A1 * 12/2019 Rushing ..... A45F 4/02
2020/0000208 A1 * 1/2020 Liu ..... A45F 3/042
2020/0025523 A1 * 1/2020 Ross ..... A45F 3/06
2020/0124384 A1 4/2020 Landtiser
2020/0132417 A1 * 4/2020 Xiang ..... B42F 7/00
2020/0237066 A1 * 7/2020 Lin ..... A45C 7/0086

* cited by examiner

PERSONAL PROTECTIVE DEVICES WITH CARRYING BAGS

The various embodiments relate to personal protective devices comprising carrying bags, such as purses and side bags, normally adapted to be worn on the side or front of a person for carrying various personal items, and protective vests which are selectively positionable within a carrying bag and selectively deployable from a ready state to a deployed configuration to protect all or a portion of the wearer's torso.

RELATED APPLICATION DATA

This application is a continuation of U.S. application Ser. No. 16/811,496, filed on Mar. 6, 2020, which claims the benefit of U.S. Provisional Patent Application Ser. No. 62/841,756, filed May 1, 2019, which are hereby incorporated by reference.

BACKGROUND

In light of the incidence and related media coverage of random, multiple shootings and knife attacks, there is a need for personal protection devices which are close at hand and quickly deployable. Various personal carrying cases and bags which are convertible into protective vests have been disclosed. Many such bags have been in the form of backpacks which are not desired to be carried by some users and/or used during certain occasions. Other previously disclosed bags and cases appear larger than desired by some users.

SUMMARY

The various embodiments of the present invention comprise carrying bags, such as purses and valises. A separate bullet resistant vest or penetration resistant (to stab wounds) vest comprises at least one neck sling and at least one and preferably a plurality of torso straps. The bullet/penetration resistant vest is dimensioned to fit within the carrying bag. The protective vest can be carried within the carrying bag when the user believes she may be going to a place with a risk of danger, such as a public place, or can be left out of the carrying bag if the user believes she is going to a place with no risk of attack, for example, to the home of a close relative. The carrying bags therefore provide the user with total flexibility with respect to whether to include the protective vest, along with its inherent weight and bulk, on any particular outing.

The carrying bags are configured to provide a "ready state" wherein the protective shield and neck sling are positioned within the carrying bag and at least a portion of the deployable torso strap(s) is on the exterior of the carrying bag and available for immediate deployment. The carrying bags comprise at least one and preferably a plurality of small slots or openings, preferably on the rear surface of the bag, i.e. the surface which would normally face the person wearing the carrying bag when the person is walking with the bag over her shoulder. The slots are designed to allow a portion of the torso strap(s) including the connectors to be pre-fed from the interior of the carrying bag to a position exterior of the carrying bag, preferably adjacent to or abutting the exterior of the carrying bag. In this "ready state", it is preferred that the majority of the torso strap is maintained within the interior of the carrying bag. When a portion of a torso strap is located on the outside of the carrying bag, the remainder of the torso strap can be rapidly deployed by the user by grasping the exterior portion of the strap and pulling the rest of the torso strap through the slot from the interior of the carrying bag. As the user is withdrawing the torso strap from the interior of the carrying bag, the strap can be wrapped around the torso of the user and secured to maintain the protective vest in the deployed position.

DETAILED DESCRIPTION

Figure 1:
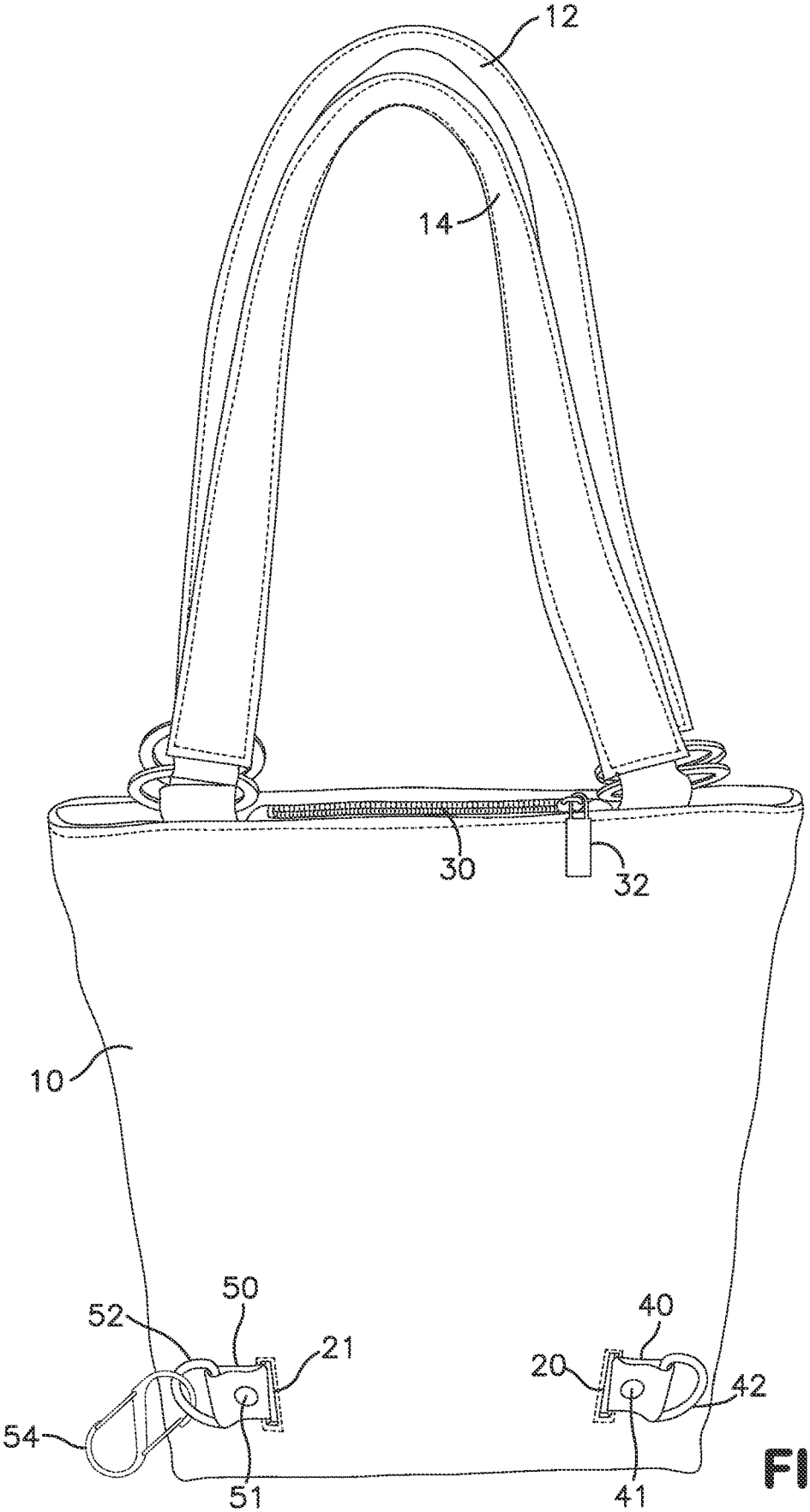
FIG. 1 is a rear, perspective view of a personal protective device in the ready state.

Three personal protective devices are described below and shown in the figures. The illustrated personal protective devices share the following features including a carrying bag and a protective vest. The carrying bags can be in many forms and are usable as a side bag to carry items, e.g. personal items. For example, the carrying bag can be in the form of a mid-size side bag, such as a messenger bag, courier bag, sling bag, etc., can be a smaller carrying bag such as a purse, tote bag or a larger carrying bag such as a computer bag. The carrying bag can be designed to be normally worn only over the wearer's shoulder or with shoulder straps extending across the wearer's chest so that the bag rests on the wearer's lower back and/or hip. The carrying bags are not bags which are designed to be carried primarily on a wearer's back, such as a backpack. The bag preferably has one or more inner compartments for holding various items such as cash, credit cards, small personal items, concealed weapons, etc., in addition to the protective shield.

Each carrying bag comprises at least one shoulder strap for supporting the carrying bag from the wearer's shoulder and/or a handle to facilitate carrying the bag at the user's side during normal use. Each carrying bag also comprises a selectively openable access to the interior of the carrying bag and at least one slot, and preferably at least two slots extending through the rear side of the carrying bag, for the torso strap(s) of the protective vest.

A bullet resistant vest is designed to prevent penetration of bullets, bomb fragments, shrapnel, knife points and similar harmful projectiles in an emergency. The bullet resistant vest is selectively insertable and removable from the carrying bag. Since it is selectively removable, the ballistic vest can be removed and the carrying bag can be used as an ordinary purse, briefcase, side bag, valise, computer bag, etc. without the additional bulk and weight of the bullet resistant vest.

A protective vest comprises a shield envelope, a protective shield, a normally concealed but rapidly deployable neck sling and at least one retractable/deployable torso strap which preferably has a permanently secured end and a securable, free end. The neck sling and the torso strap(s) are connected to the shield envelope. The protective shield, which is located within the shield envelope, is preferably a soft armor, multi-layered insert, e.g. formed of multiple layers of polyethylene, or polyurethane with Aramid fabric, KEVLAR®, ARTEC® or other bullet-resistant fabric composition. The protective insert can be entirely rigid, soft and pliable, or can have both rigid and pliable portions where the rigid portions are foldable relatively to each other. The bullet-resistant insert preferably meets or exceeds Type IIA body armor classification as set forth in Ballistic Resistance of Body Armor NIJ Standard-0101.06, established by the National Institute of Justice of the U.S. Department of Justice. At a minimum, the protective shield has a penetration resistance equal to at least Protection Level 1 of the "Spike" protection class as set forth in Stab Resistance of Personal Body Armor, NIJ Standard-0115.00, established by the National Institute of Justice of the U.S. Department of Justice. Therefore, the protective shields can have a penetration resistance of Levels 1, 2 or 3 for "Spike" or "Edged Blade" protection classes of stab resistance or Levels IIA, II, IIIA, III or IV for penetration resistance to gunfire.

As used herein, the term "penetration resistant" indicates that the item being described, e.g. a vest, shield or insert, exhibits at least penetration resistance Level 1 for "Spike" protection classes of stab resistance as described above. The term "bullet resistant" indicates that the item being described, e.g. a vest, shield or insert, exhibits at least Level IIA penetration resistance to gunfire as described above. The term "protective", when used to describe a vest, shield or insert, includes items which are either or both "penetration resistant" and/or "bullet resistant" as defined herein.

While examples discussed below refer to women users, the personal protective devices are equally applicable to men and younger users such as teens and children. Various aspects will be understood with reference to the figures.

Figure 6:
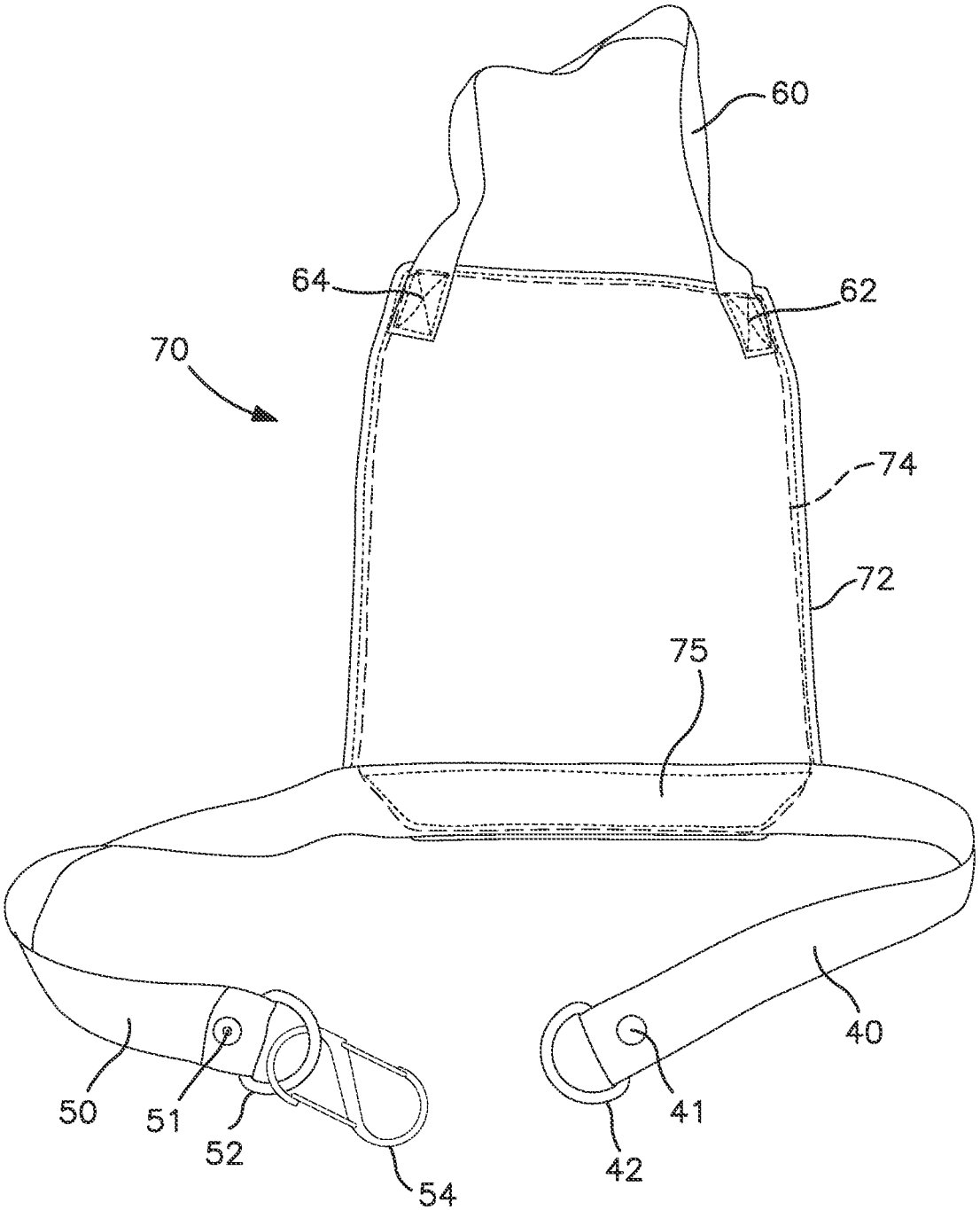
FIG. 6 is a rear perspective view of the protective vest shown in FIG. 2.
Figure 7:
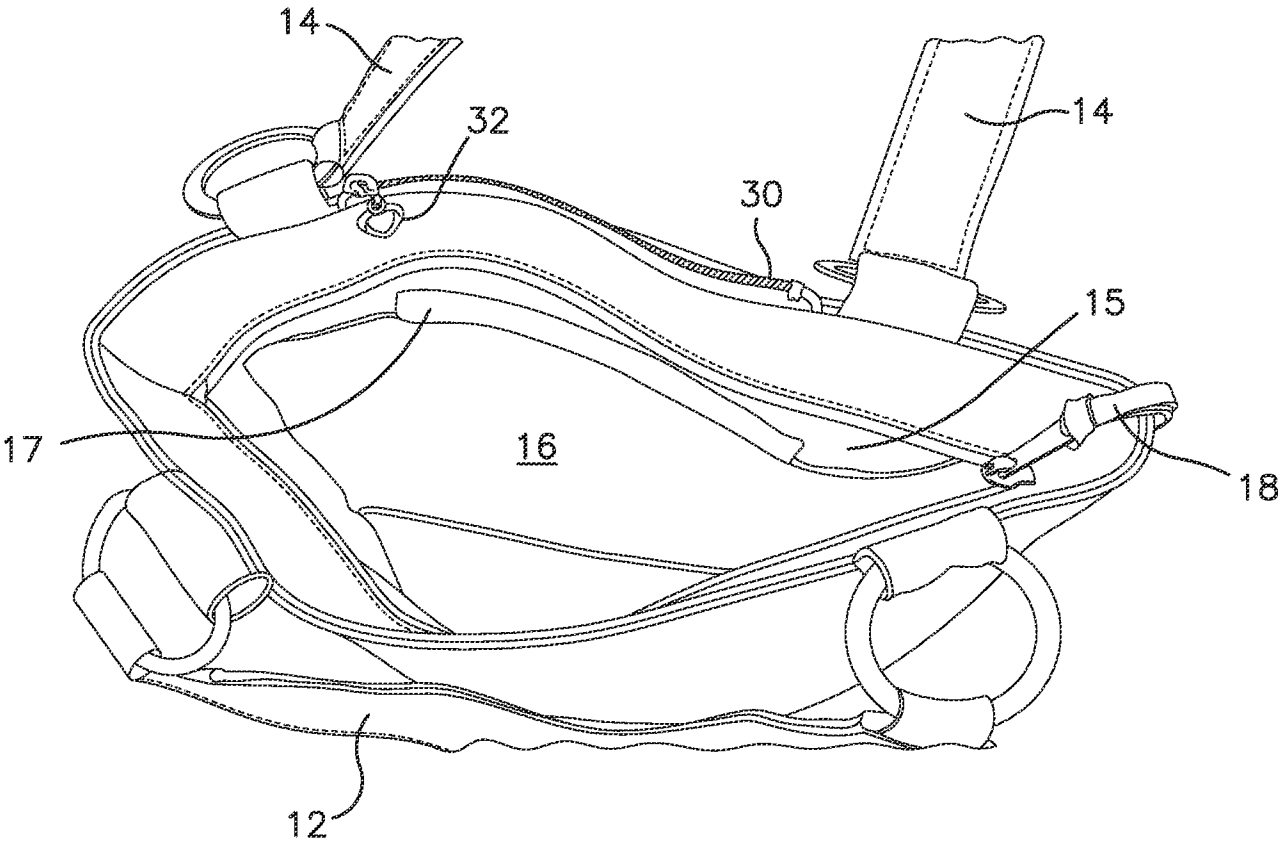
FIG. 7 is a top, perspective view of the carrying bag shown in FIG. 1 with the top opened.
Figure 8:
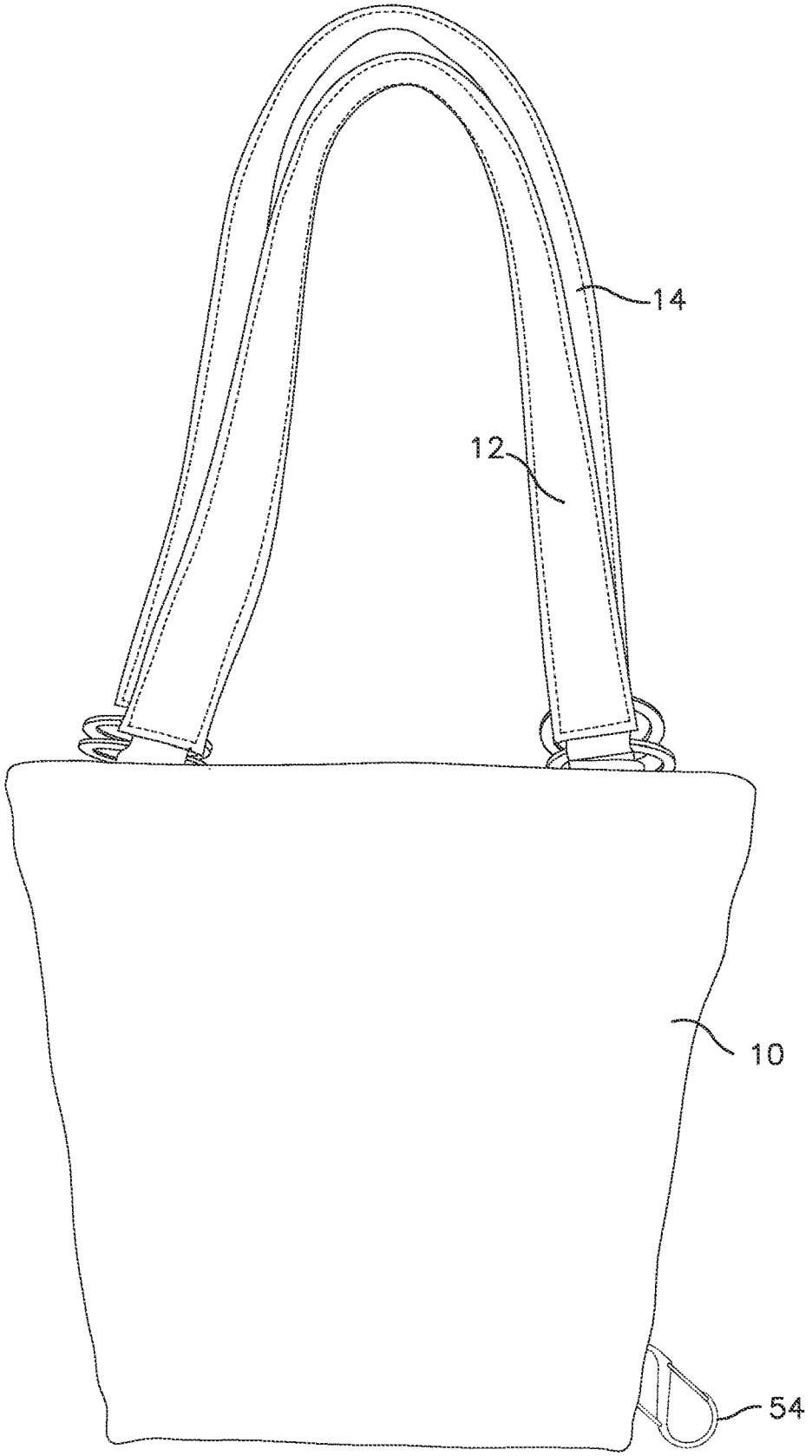
FIG. 8 is a front, perspective view of the personal protective device shown in FIG. 1.
Figure 9:
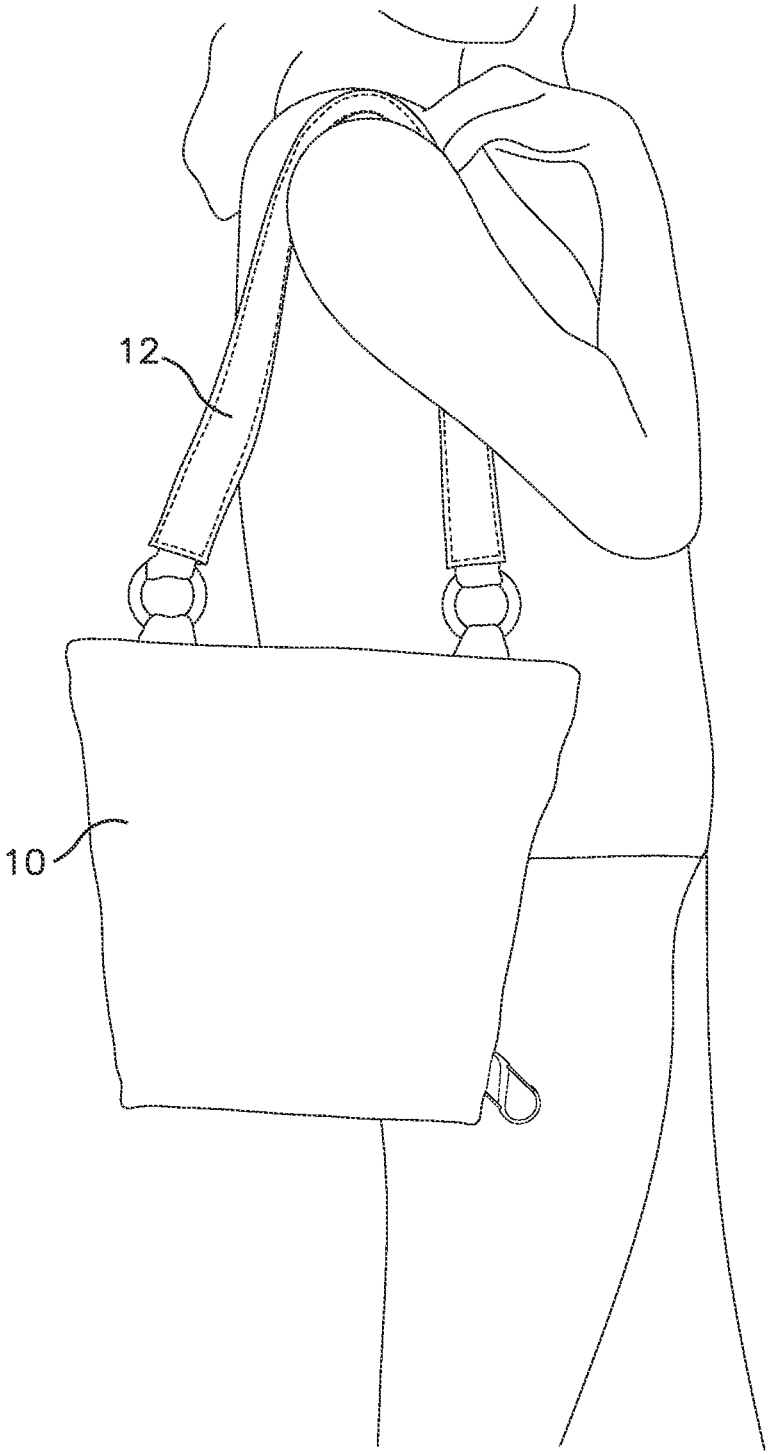
FIG. 9 is a side perspective view of a woman carrying the personal protective device shown in FIG. 1 over her shoulder in the ready state.

FIGS. 1-12 illustrate a first personal protective device comprising a carrying bag 10 having bag carrying straps 12 and 14. As shown in FIGS. 1 and 8, carrying bag 10 is generally in the form of a woman's tote bag and can carry items, such as personal items, just like a standard handbag. FIG. 8 is a front view of the personal protective device in the ready state. This "front view" is the view which would be seen by another person when a wearer has the carrying bag 10 over her shoulder. FIG. 1 is a "rear view" which shows the side of the carrying bag 10 which faces the user/wearer during normal, everyday, i.e. non-deployed, use. Bag carrying straps 12 and 14 are dimensioned to allow bag 10 to be carried over the wearer's shoulder where they will normally support bag 10 on the side of the wearer as shown in FIG. 9. As best shown in FIG. 1, a selectively openable compartment is provided for the neck sling 60 of the protective vest 70. In this illustrated embodiment, zipper 30 having a zipper pull 32 provides access to an inner compartment which holds neck sling 60. The rear side of carrying bag 10 also comprises two slots 20 and 21 through which torso straps 40, 50 pass.

Figure 2:
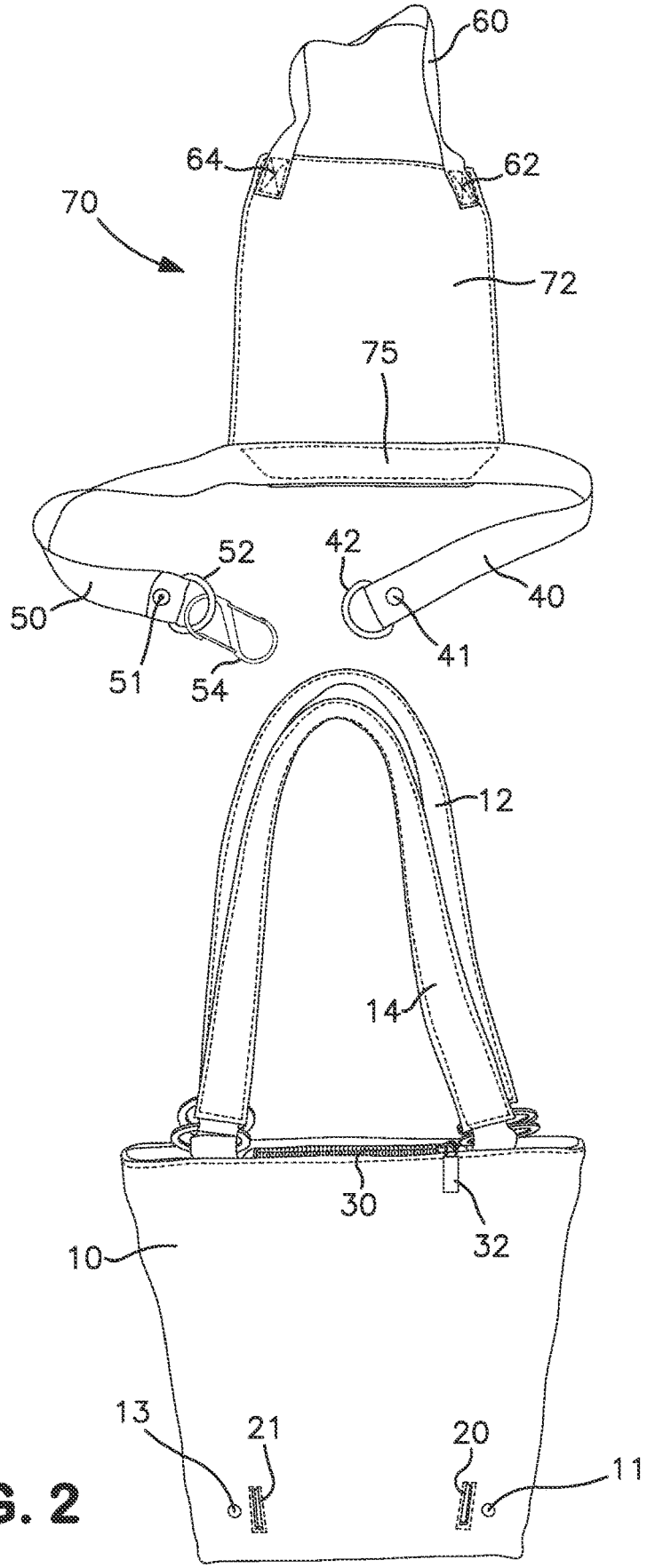
FIG. 2 is an exploded, rear perspective view of the personal protective device shown in FIG. 1.

Carrying bag 10 is designed and dimensioned to selectively carry a protective vest 70. FIG. 1 shows the protective vest 70 positioned within carrying bag 10 and in the "ready state" as described further below while the exploded view of FIG. 2 shows protective vest 70 outside of carrying bag 10.

The protective vest 70 comprises a shield envelope 72 and a protective shield 74. The shield envelope 72 is preferably entirely waterproof or has a waterproof liner and preferably blocks UV rays since moisture and UV rays may be harmful to the protective shield 74. The protective vest 70, shield envelope 72 and penetration resistant shield 74 are shown in FIG. 6. The penetration resistant shield 74 is indicated by dashed lines in FIG. 6 since it is located within shield envelope 72.

The protective shield can take any desired regular or irregular shape such as rectangular or elliptical and can have squared or rounded edges. The illustrated, exemplary protective vest 70 comprises a neck sling 60 which is secured to spaced, upper right portion 62 and left portion 64 of the shield envelope 72. The attachment of the neck sling 60 at portions 62 and 64 is preferably a secure connection, and can be by stitching as best illustrated in FIG. 6 or by another form of attachment such as Velcro®, riveting or snaps. The stitching illustrated with small dashed lines at connection portions 62 and 64, as well as stitching shown horizontally along the edge of the protective shield envelope 72 and passing through the upper portion of the connected portion of the torso straps and the bottom portion 75 of the shield envelope 72 preferably also passes through the protective shield 74. This stitching holds the protective vest portions together and helps to maintain the protective shield in proper position within shield envelope 72.

Neck sling 60 can have a fixed length but is preferably formed of a stretchable material. The deployable neck sling is preferably shorter than a standard shoulder strap commonly found on a women's or men's purse which is designed to be positioned next to the wearer's hips while strolling. The neck sling is designed and dimensioned to support the protective vest in front of the wearer's chest.

When the terms "front" and "rear" are used with reference to a bag or portions of a bag, the terms refer to the same directions as the front and rear of the wearer, respectively, when the bag is positioned in front of the wearer in the deployed position.

As best shown in FIGS. 2 and 6, the protective vest 70 also comprises two torso straps, namely a right torso strap 40 and a left torso strap 50. Torso straps can be formed separately or from a single length of material as illustrated and can have a fixed length or be formed of a stretchable material. The illustrated torso straps 40, 50 are secured to a bottom portion 75 of shield envelope 72, e.g. by stitching as illustrated, or by some other method. The free ends of the illustrated torso straps are provided with connectors for securing the straps together. In the illustrated embodiment, the free end of right torso strap 40 is provided with a D-ring 42 and the free end of left torso strap 50 is provided with a D-ring 52 and a carabiner 54. The free ends of the one or more straps can be normally maintained in position on the exterior of the carrying bag by easily releasable connectors such as Velcro®, magnets, snaps, etc. As best shown in FIG. 2, in this illustrated embodiment, right strap 40 has a snap portion 41 which normally engages complementary snap portion 11 on carrying bag 10 when the personal protective device is in the ready state. Similarly, left strap 50 has a snap portion 51 which snaps onto complementary snap portion 13 connected to carrying bag 10 when the personal protective device is in the ready state. These releasable connectors keep the straps neat and inhibit premature deployment of straps 40, 50 from the ready state to the deployed position. Since the protective shield is secured within the shield envelope, the protective shield is deemed to be connected to the neck sling, torso strap(s), and, in the case of personal protective device with a single torso strap, to the second connector which engages a connector on the single torso strap.

Figure 3:
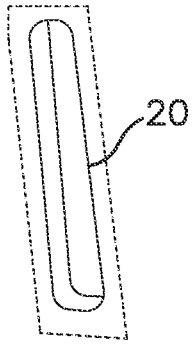
FIG. 3 is a close-up perspective view of a slot in the rear of the carrying bag shown in FIG. 1.
Figure 4:
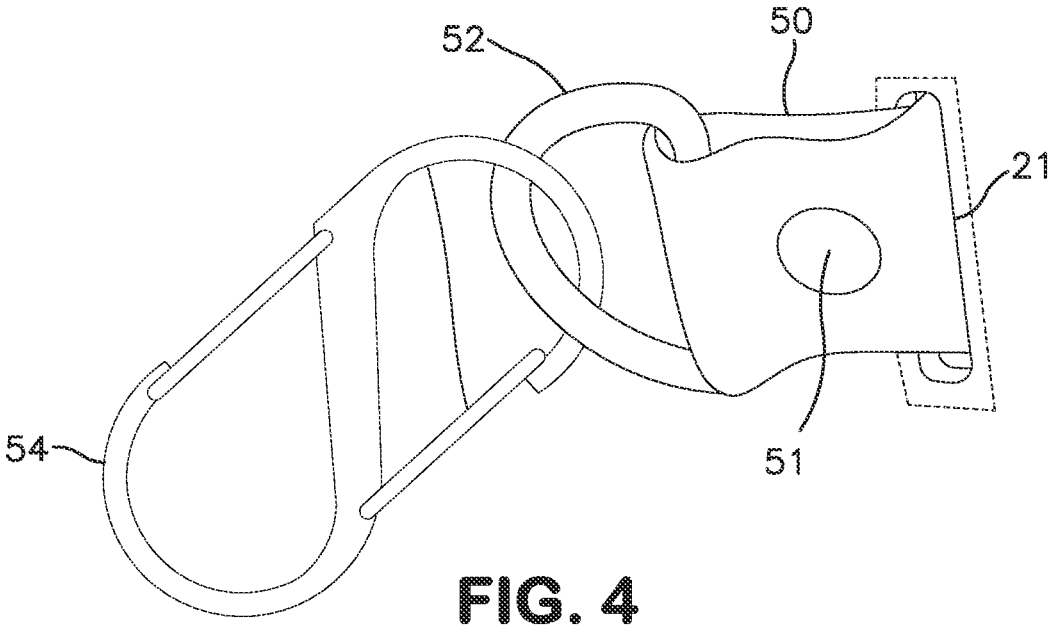
FIG. 4 is a close-up perspective view of a slot in the rear of the carrying bag and a torso strap shown in FIG. 1.

The carrying bag 10 comprises a pair of spaced slots, namely right slot 20 and left slot 21, which extend through the rear panel of carrying bag 10. FIG. 3 is a close-up view of slot 20 which is surrounded by reinforcing stitching (shown in dashed lines). Slots 20 and 21 permit portions of the torso straps to be pre-fed from the interior of the carrying bag 10 to positions outside of the carrying bag 10, and preferably closely adjacent to the rear, exterior side of the slots 20, 21. In FIG. 1, the free end of left torso strap 50, D-ring 52 and clasp 54 have been pre-fed through slot 20. Similarly, the free end of right torso strap 40 and D-ring 42 have been pre-fed through slot 21. In this configuration, the torso straps are in a "ready state" and are ready to be withdrawn from the interior of carrying bag 10. FIG. 4 is a close-up view of slot 21 with strap 50 of the protective vest 70 in the "ready state" showing the free end of torso strap 50, D-ring 52 and clasp 54 pre-fed from the interior of carrying bag 10 through slot 20 to a position outside of carrying bag 10. Snap portions 51 and 13 are engaged to maintain the free end of strap 50 on the rear side of carrying bag 10.

Carrying bag 10 also comprises a zipper 30 and a zipper pull tab 32 which, when the zipper is open, provide access to the interior of bag 10 and neck sling 60 of protective vest 70.

Figure 5:
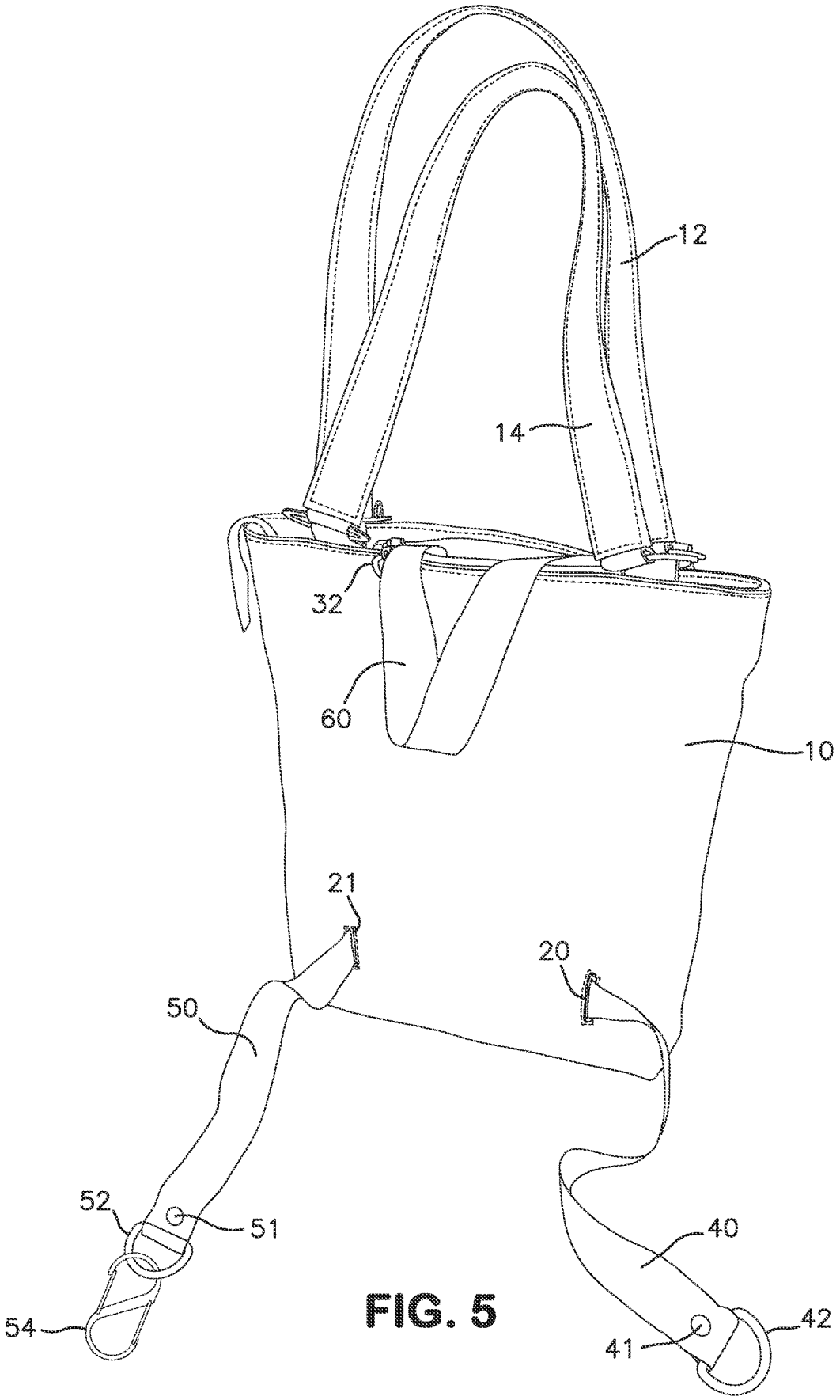
FIG. 5 is a rear perspective view of the personal protective device shown in FIG. 1 with the neck sling and torso straps in the deployed configuration.
Figure 10:
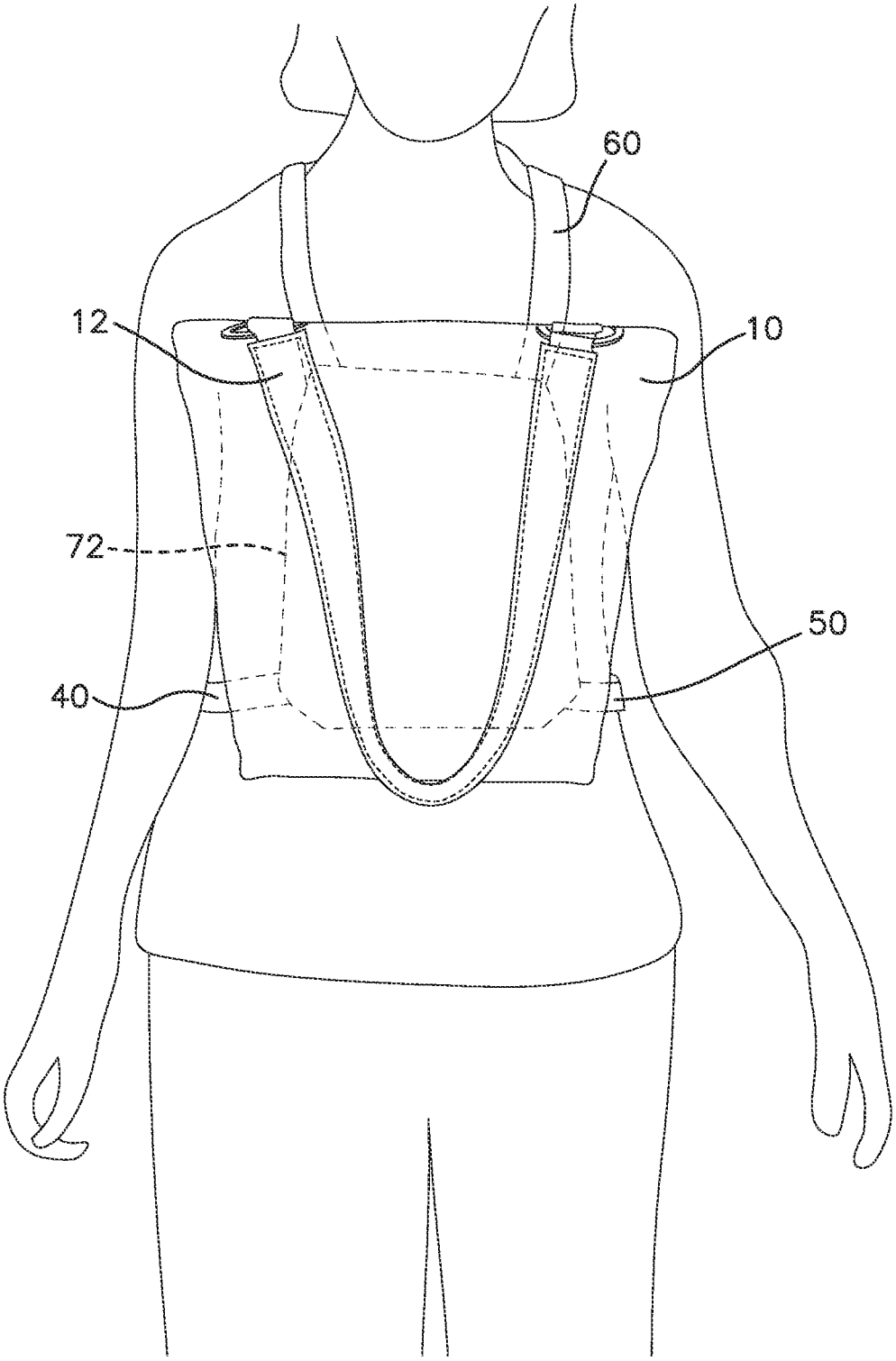
FIG. 10 is a front view of a woman wearing the personal protective device shown in FIG. 1 in the deployed configuration.
Figure 11:
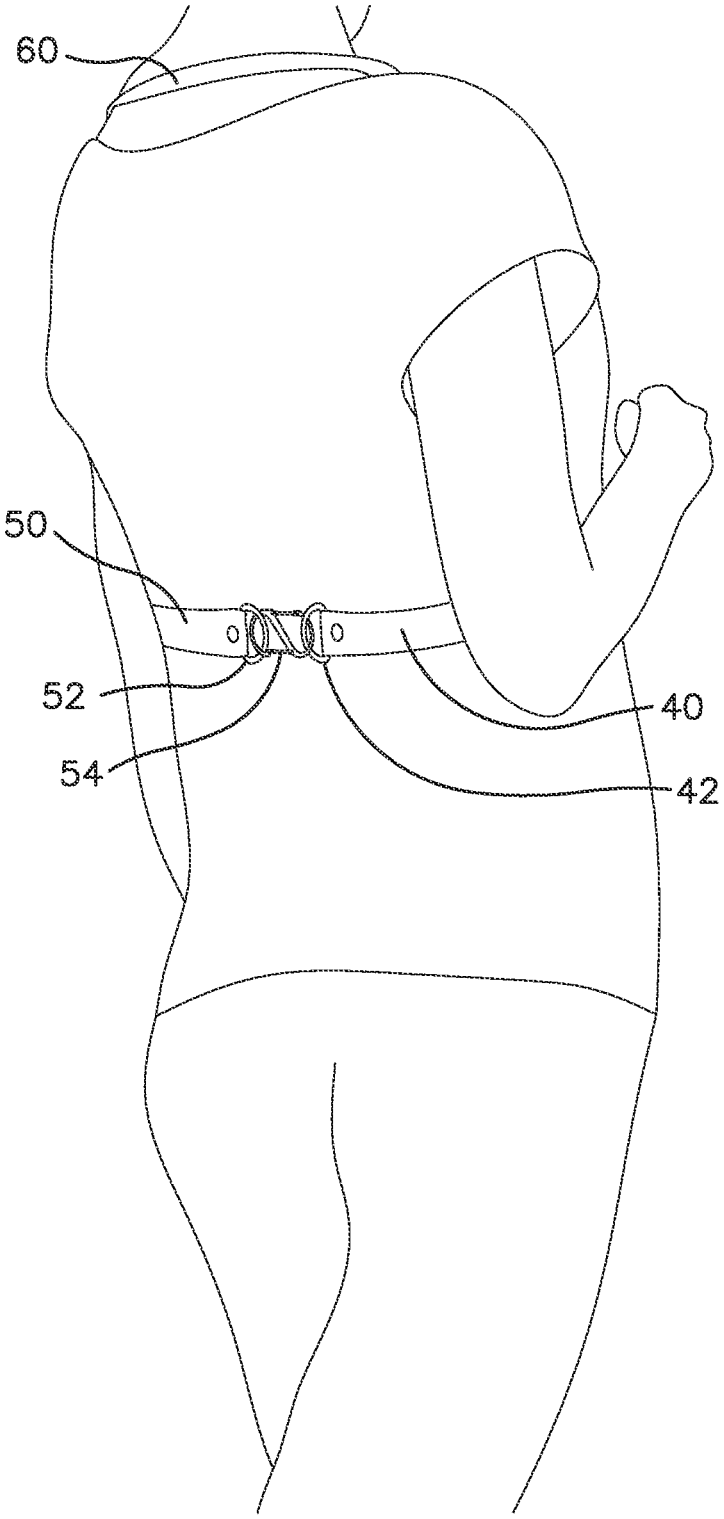
FIG. 11 is a rear, perspective view of a woman wearing the personal protective device shown in FIG. 1 in the deployed configuration.
Figure 12:
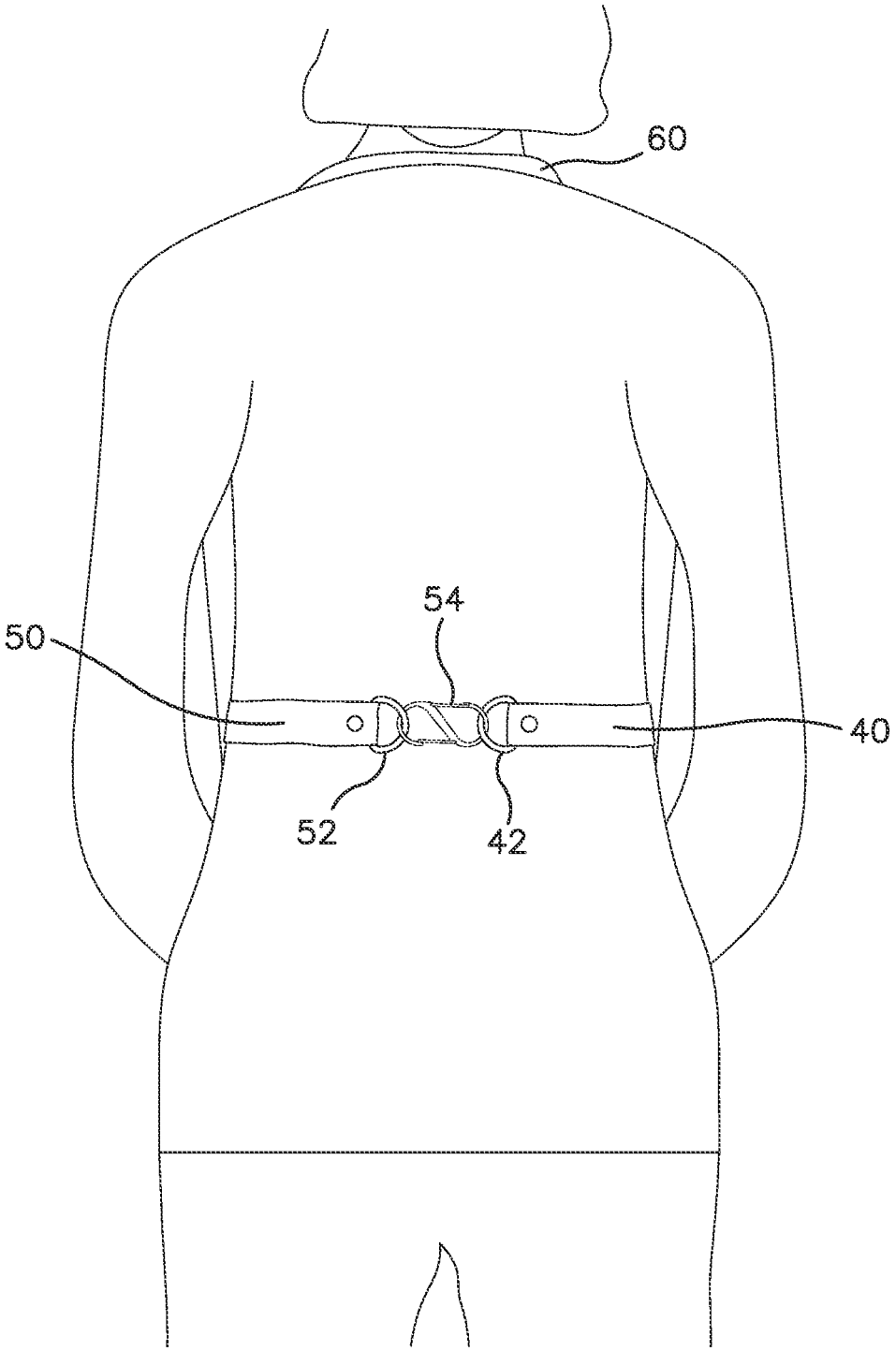
FIG. 12 is a rear view of a woman wearing the personal protective device shown in FIG. 1 in the deployed configuration.

FIG. 9 illustrates a woman carrying the personal protective device shown in FIGS. 1-8 in a normal, non-deployed position. In a situation where the wearer desires protection, such as when there is a perceived threat of injury from a gun, knife or bomb, the wearer could first position the bag in front of her torso. She then only needs to open zipper 30, withdraw neck sling 60, place neck sling 60 around her neck, withdraw torso straps 40 and 50 to a sufficient extent so the torso straps 40 and 50 can be wrapped around her torso and then secure the torso straps 40, 50 around her by connecting clasp 54 to D-ring 42. FIG. 5 shows the personal protective device in the deployed configuration with neck sling 60 and both torso straps 40 and 50 deployed to positions outside of the carrying bag 10. FIG. 10 illustrates the personal protective device deployed on the woman illustrated in FIG. 9 with neck sling 60 draped around her neck, torso straps 40 and 50 secured around her torso, front bag strap 12 hanging freely in front of carrying bag 10 and shield envelope 72 shown in phantom. FIGS. 11 and 12 are rear perspective and rear views, respectively, of the personal protective device deployed on the woman as shown in FIG. 10 with neck sling 60 draped around her neck, and with torso straps 40 and 50 secured around her torso via D-rings 42, 52 and carabiner 54. It will be appreciated from the figures that only a small portion of each of torso straps 40, 50 has been extended through their respective slots 20, 21 to a position exterior to carrying bag 10 when the protective device is in the ready state. This is accomplished either during assembly prior to sale or when a user is positioning a protective vest within the carrying case so that the protection in the event that circumstances warrant. As noted above, the personal protective devices advantageously provide a user with the option of removing the protective vest when desired. A larger portion, and preferably substantially all, of each torso strap 40, 50 is extended through slots 20, 21 to positions exterior of carrying bag 10 when the torso straps 40, 50 have been extended to the deployed configuration.

Figure 22:
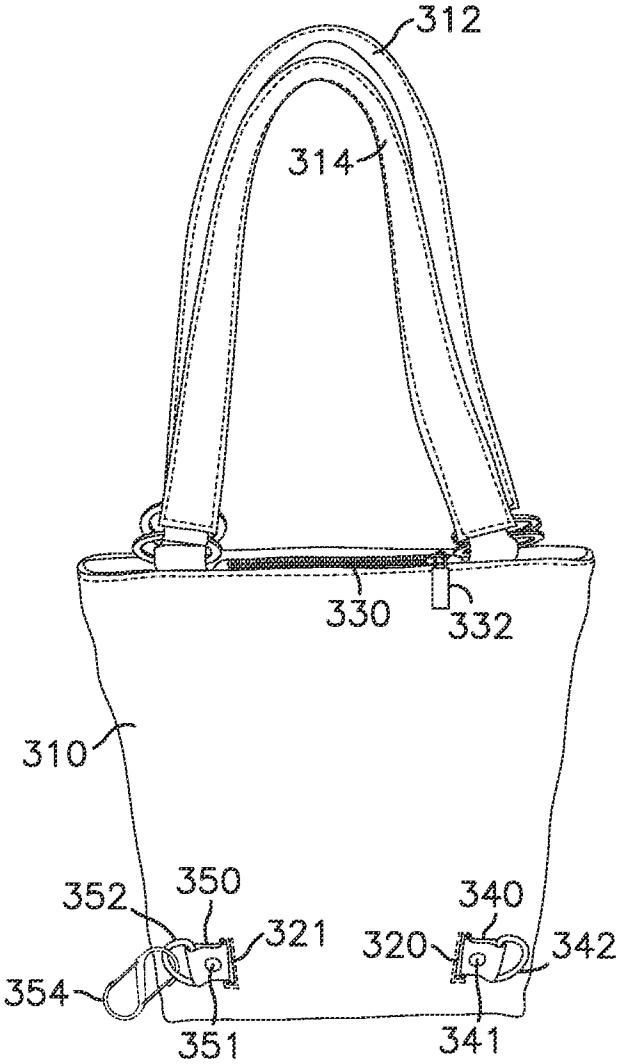
FIG. 22 is a rear, perspective view of a personal protective device having the protective vest shown in FIG. 21 in the ready state.
Figure 21:
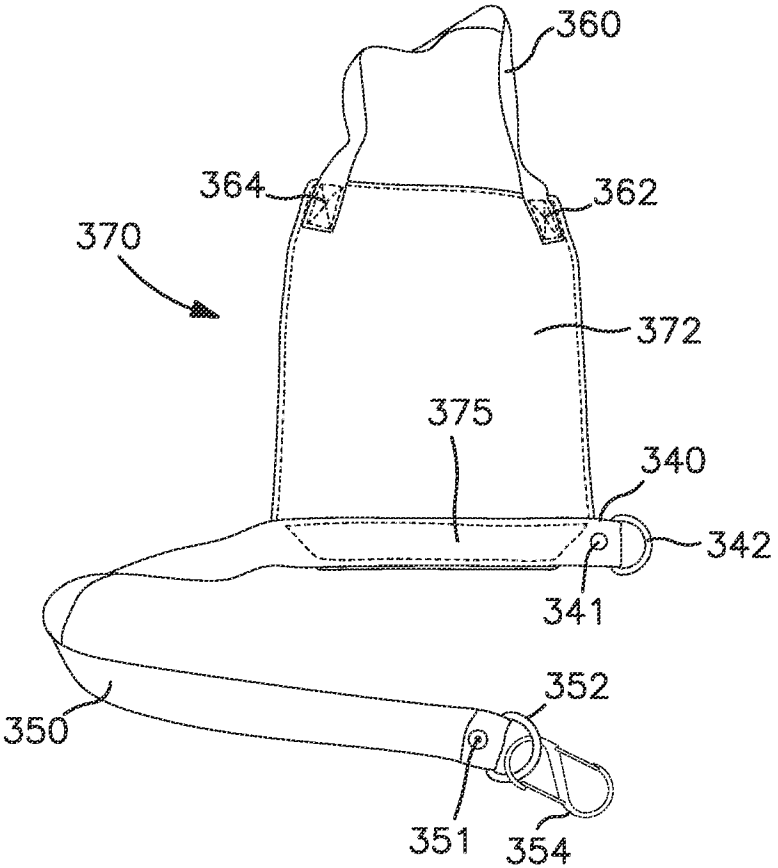
FIG. 21 is a rear perspective view of a protective vest shown comprising a single torso strap.

In an alternative embodiment, illustrated in FIGS. 21 and 22, a personal protective device similar to the devices shown in FIGS. 1-12 is designed for the wearer to only need to handle a single torso strap as she deploys the device from the ready state to the deployed configuration. This version of a single strap embodiment has a single strap with a fixed end and a free end. The fixed end of the single strap is connected to the shield envelope while the free end of the single strap is provided with a selectively releasable connector designed to engage another connector which is also secured to the shield envelope of the protective vest. The device illustrated in FIGS. 21 and 22 has a single torso strap 350 with selectively releasable connectors on the free end including a snap portion 351, D-ring 352 and carabiner 354. A corresponding D-ring 342 is secured to shield envelope 372 of protective vest 370 via a connector 340 which is attached to the shield envelope 372 at a location which is spaced from the position where torso strap 350 is connected to shield envelope 372. FIG. 22 shows the positioning of the single strap 350, D-ring 352 and carabiner 354, as well as connector 340 and D-ring 342 on the outside of carrying bag 310. With this version, when a wearer wishes to deploy the protective vest, she only needs to deploy the neck sling 360 and withdraw a single strap, namely strap 350, from the interior of carrying bag 310 through slot 321 and secure carabiner 354 to D-ring 342. The other components of the personal protective device shown in FIGS. 21-22 are the same as those of the device shown in FIGS. 1-12 and are numbered with similarly with all numbers increased by 300. It will be appreciated that the outward appearance of the personal protective device shown in FIGS. 21-22 is the same as the device shown in FIGS. 1-12 when the devices are in their ready states.

In the version shown in FIGS. 21 and 22, as well as in other versions, the connectors can be plastic clips, e.g. a male and corresponding female clip, a ring, such as a D-ring, and a clasp such as the clasp shown in FIGS. 1-8, or the like.

The arrangement of the disclosed embodiments, namely providing a protective shield within a protective vest, when properly deployed on the front of a wearer's torso, is preferable to other bullet resistant devices which are deployable as handheld shields since a handheld shield is more likely to deflect an incoming bullet while a bullet-resistant vest worn on a person's torso is more likely to stop a bullet. The contact between the bullet-resistant vest and a wearer's torso will cause the torso to absorb the force of a bullet's impact but prevent penetration of the bullet or knife into the protected portion of the wearer's body. On the other hand, a hand-held shield can easily deflect a bullet into the wearer or a nearby person, or the shield can be knocked out of the person's hand by the force of the bullet. After deployment, the disclosed embodiments keep the wearer's hands free and in a more natural position enabling the wearer to engage in desired activities such as running, crawling, crouching, throwing, fighting, etc.

FIG. 7 shows the interior 16 of the illustrated carrying bag 10 which comprises a side pocket 15 for receiving the protective vest 70. A Velcro® flap 17 located within the interior of carrying bag 10 is used to close the top opening of pocket 15 and help maintain the protective vest 70 in position during normal use. Another type of releasable closure, such as a zipper, could also be used to close the top opening of pocket 15. From the present description, it will also be appreciated that pre-feeding portions of the torso straps 40, 50 through slots 20, 21 helps to maintain the protective vest 70 in position within carrying bag 10. In other respects, i.e. other than the zippered access for the neck sling 60 and slots 20, 21, the interior of carrying bag 10 can have conventional features such as dividers and additional closable compartments. The exterior of carrying bag 10 is also otherwise conventional as illustrated in FIG. 8 which shows the front exterior carrying bag 10.

Figure 13:
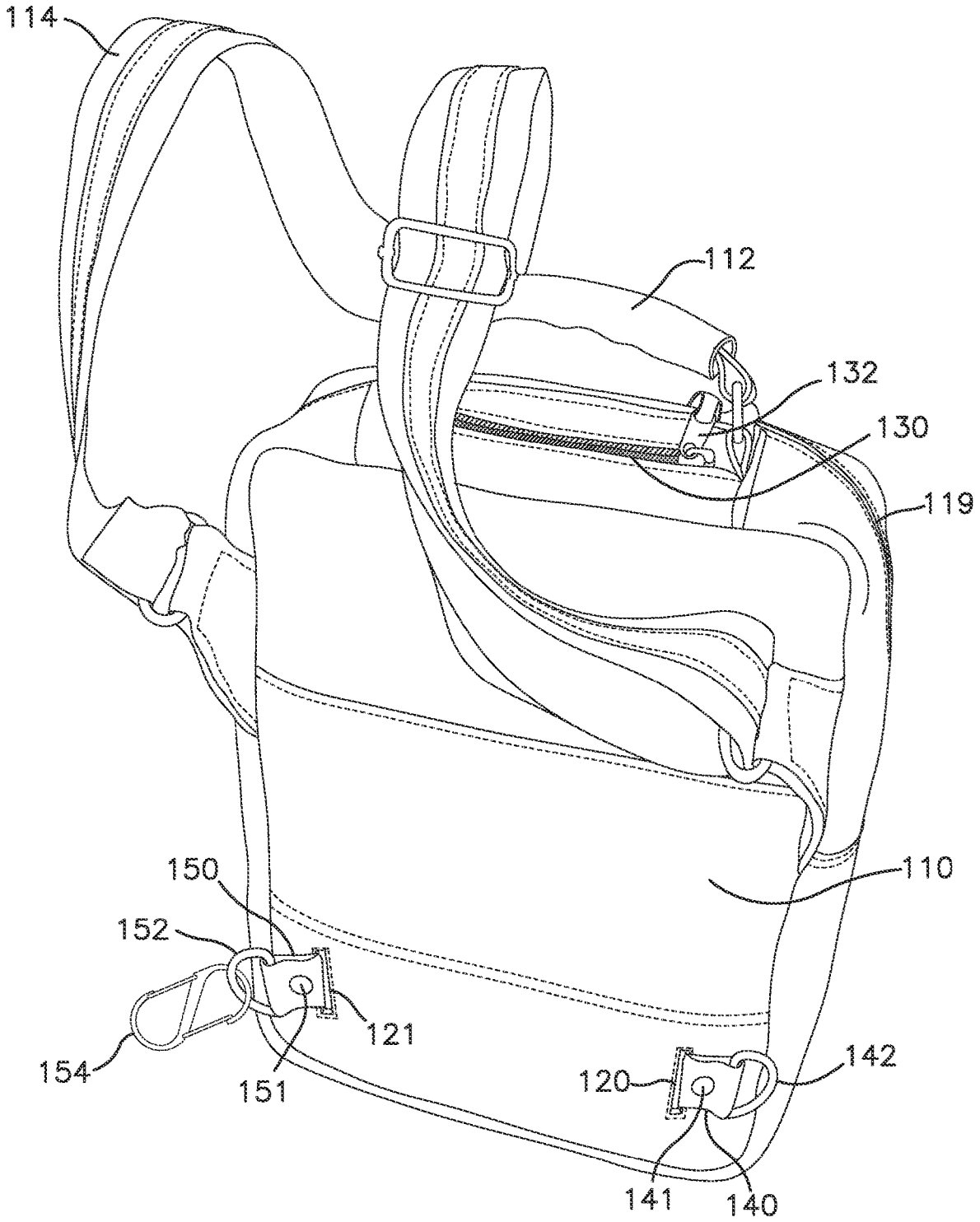
FIG. 13 is a rear, perspective view of a second personal protective device in the ready state.
Figure 14:
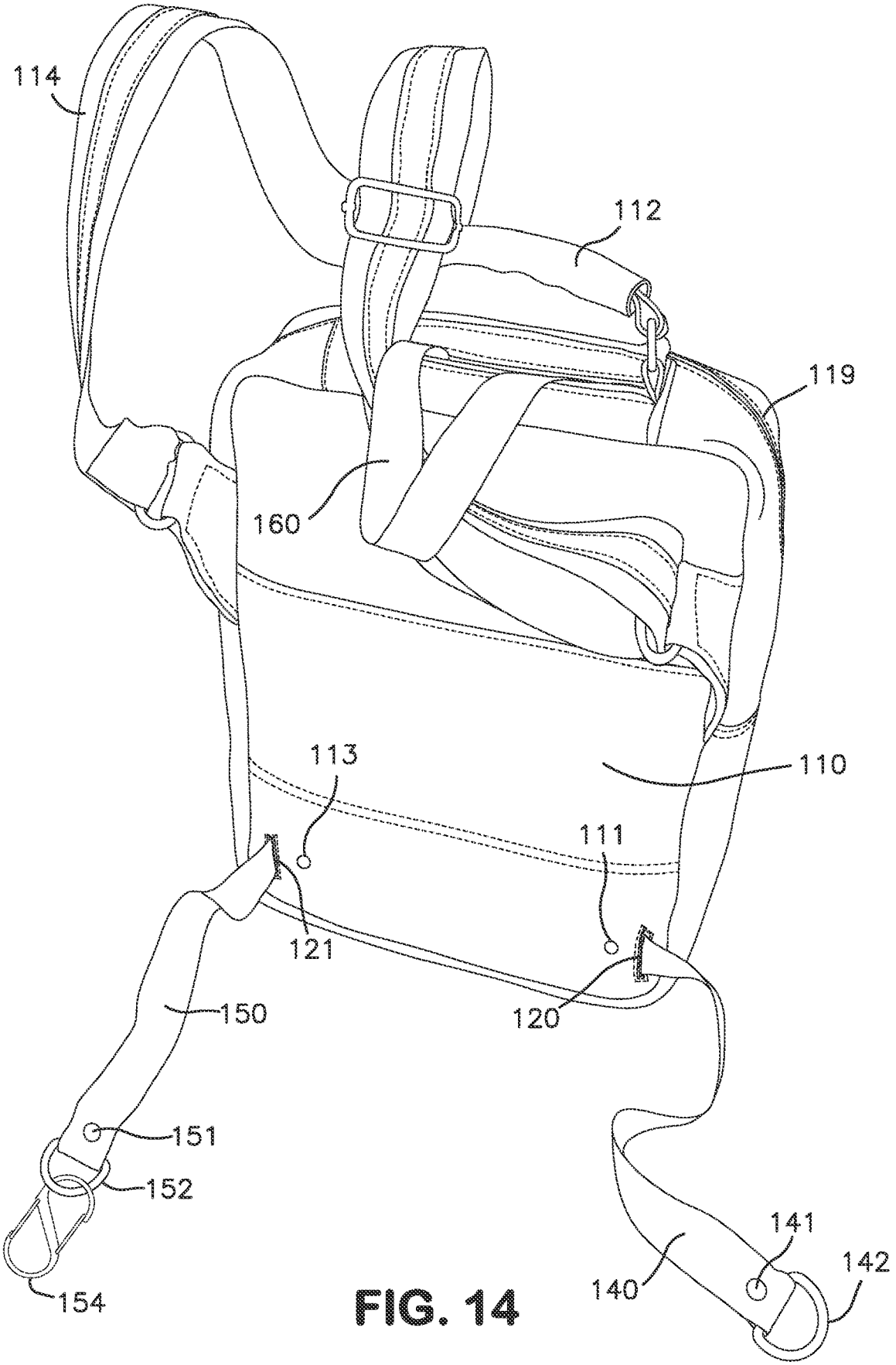
FIG. 14 is a rear perspective view of the personal protective device shown in FIG. 13 with the neck sling and torso straps in the deployed configuration.

FIGS. 13-16 show another personal protective device comprising a carrying bag 110 in the form of laptop bag, tablet bag, or other side bag. Carrying bag 110 comprises a single shoulder strap 114 and handle 112 which facilitate carrying this carrying bag 110 either like a shoulder bag or a briefcase. Other than the shape of the carrying bag 110 and the strap 114 and handle 112, the personal protective device shown in FIGS. 13-16 is similar to the personal protective device shown in FIGS. 1-12. The protective vest is oriented in the same way relative to carrying bag 110 as vest 70 is oriented to carrying bag 10. The protective vest (not shown) is positioned between the rear side of carrying bag 110 and an inner compartment wall. The zipper 130 for the neck sling opening is positioned more forwardly on carrying bag 110 than zipper 30 is positioned on carrying bag 10. Similar elements shown in FIGS. 13-16 are numbered similarly to the corresponding elements shown in FIGS. 1-12 but with the element number increased by 100. The personal protective device shown in FIGS. 13-16 is configurable in a "ready state" as shown in FIG. 13 which facilitates rapid deployment into the deployed configuration shown in FIG. 14.

Figure 15:
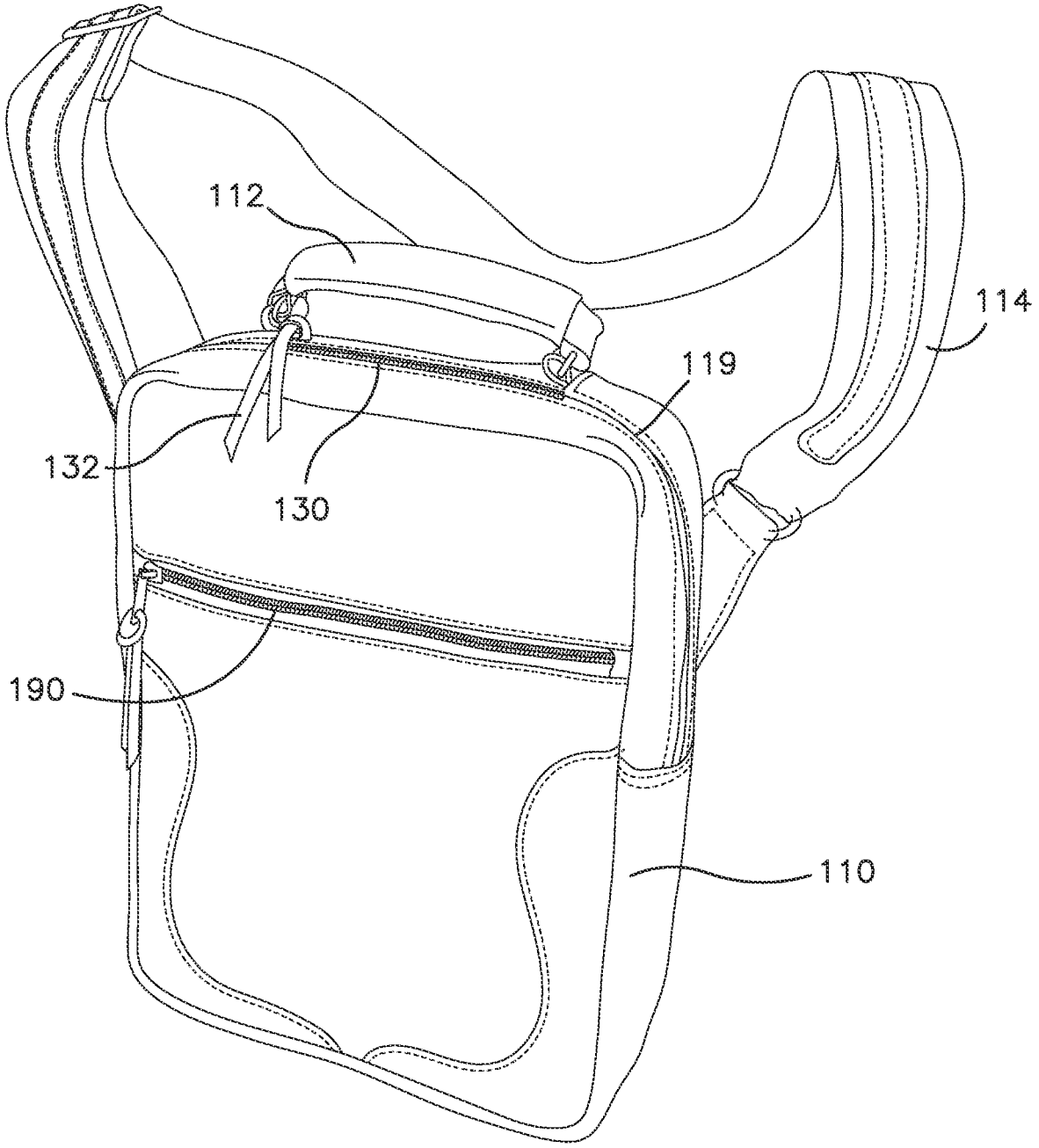
FIG. 15 is a front, perspective view of the personal protective device shown in FIG. 13.
Figure 16:
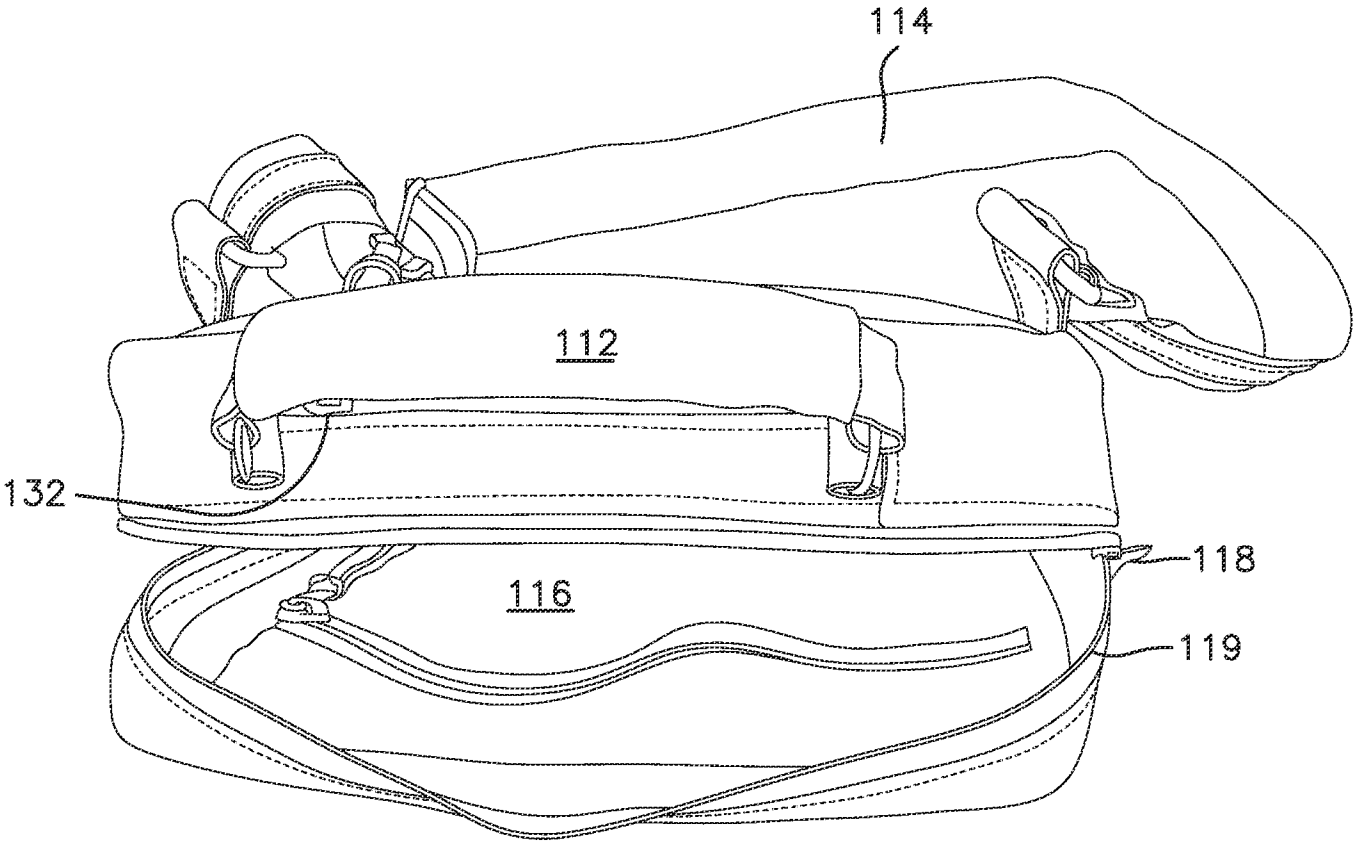
FIG. 16 is a top, perspective view of the carrying bag shown in FIG. 13 with the main zipper of the carrying bag opened.
Figure 17:
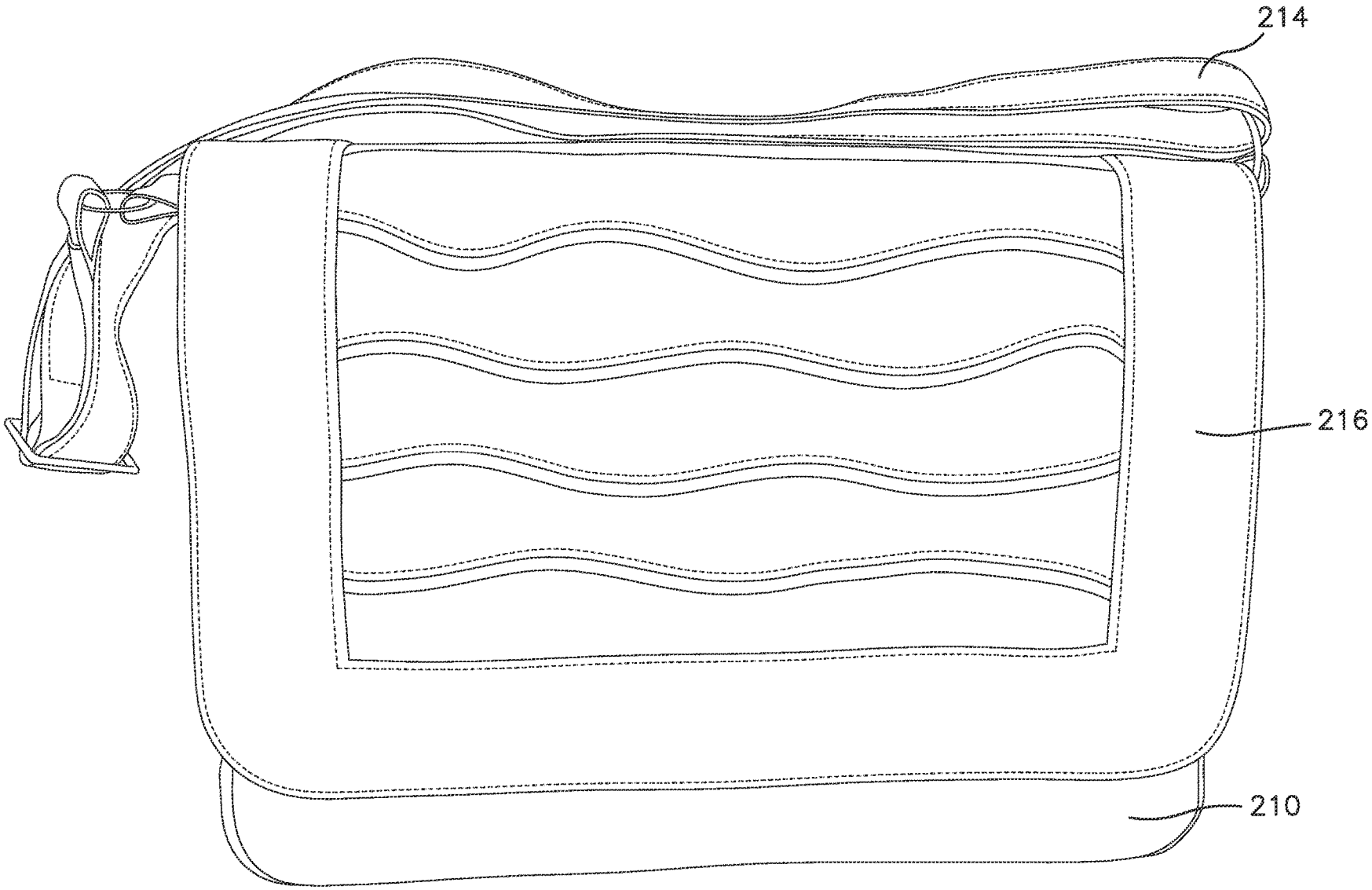
FIG. 17 is a front perspective view of a third personal protective device.

FIG. 15 shows the front of carrying bag 110. From the front, carrying bag 110 appears to be a standard bag comprising a main top opening which is selectively opened via zipper 119 and a front pocket which is also accessed via a zipper 190. FIG. 16, which is a top, perspective view of carrying bag 110, also illustrates the positioning of zipper pull tab 132 which is used to access neck sling 160 and zipper 119 which is used to access the interior 116 of carrying bag 110.

Figure 18:
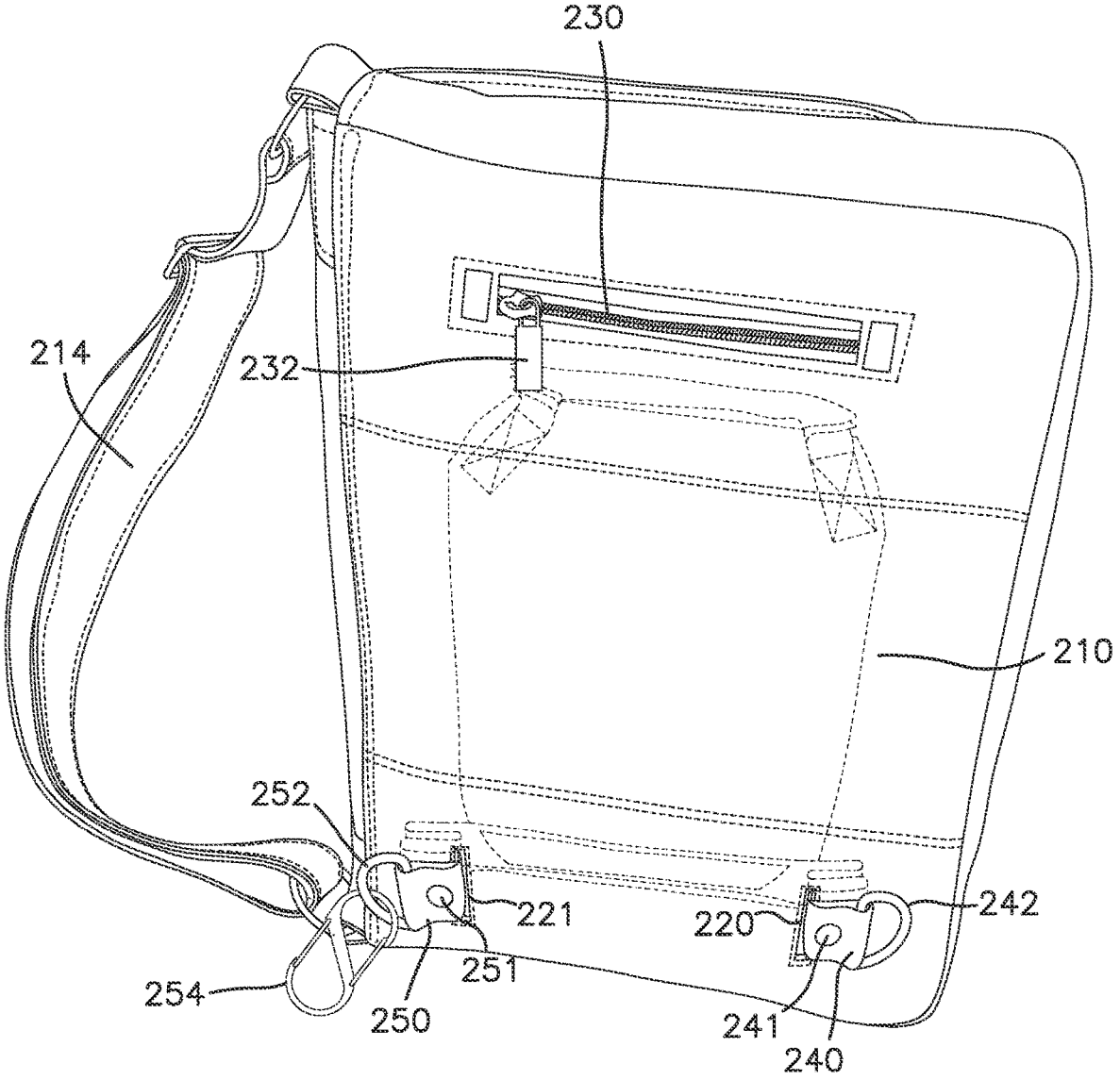
FIG. 18 is a rear, perspective view of the personal protective device shown in FIG. 17 in the ready state.
Figure 19:
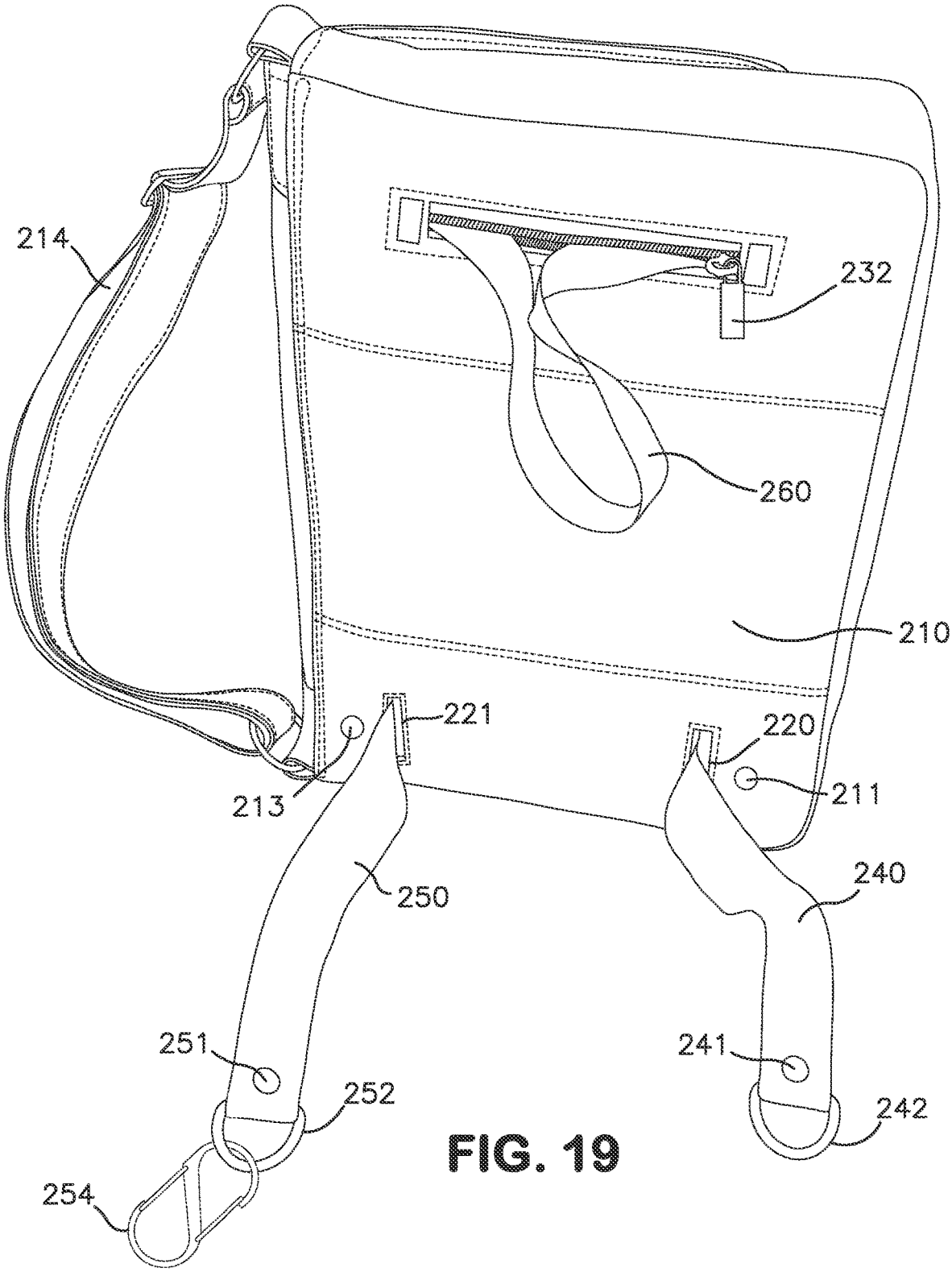
FIG. 19 is a rear perspective view of the personal protective device shown in FIG. 17 with the neck sling and torso straps in the deployed configuration.
Figure 20:
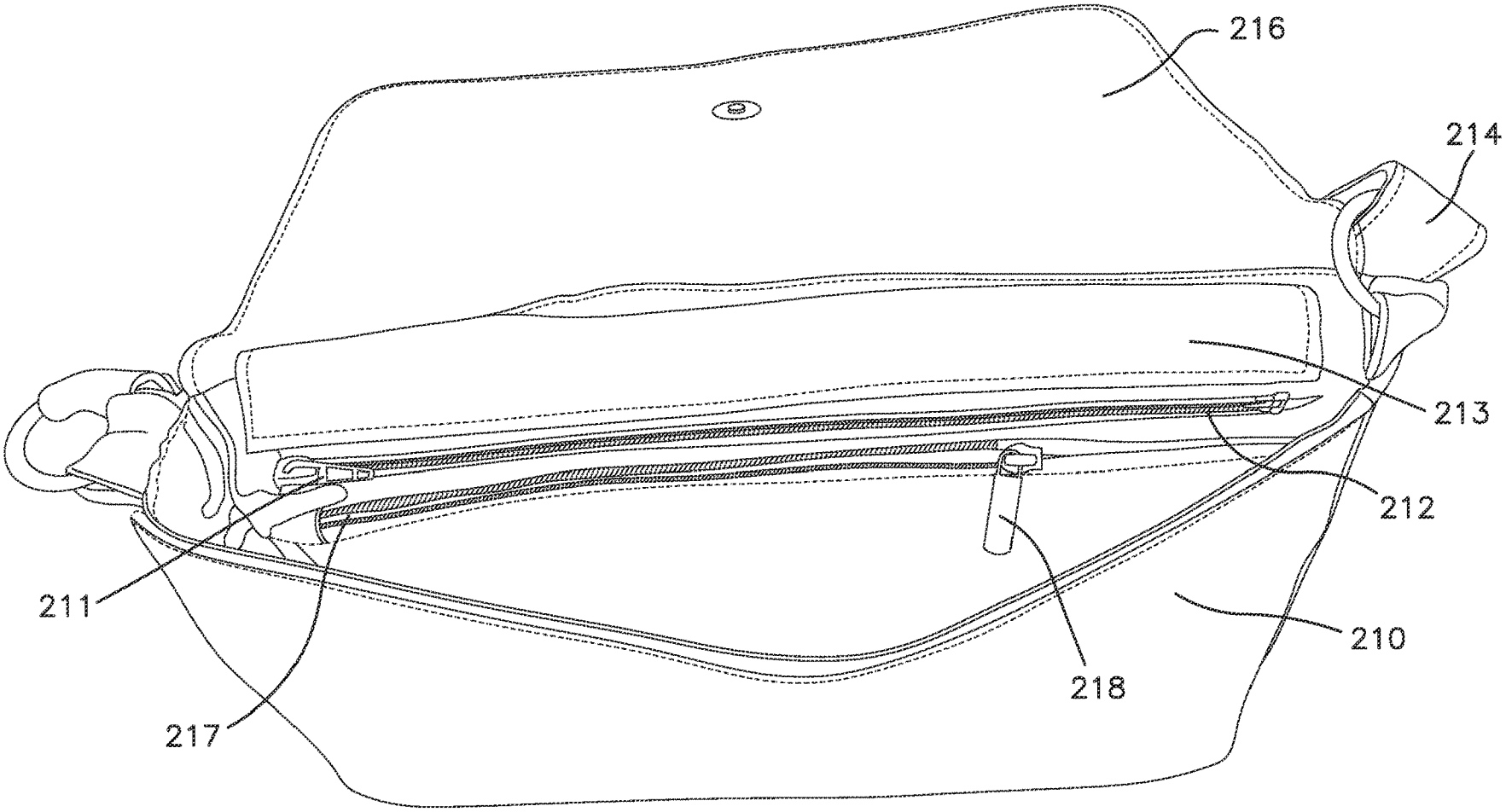
FIG. 20 is a top, perspective view of the carrying bag shown in FIG. 17 with the main zipper of the carrying bag opened.

FIGS. 17-20 illustrate a third personal protective device comprising a carrying bag 210 with a front flap 216 and a shoulder strap 214. Carrying bag 210 is generally in the shape of a purse. FIGS. 18 and 19 illustrate the straps 240, 250 of a protective vest in the "ready state" and the deployed position, respectively. Unlike the other two personal protective devices which included carrying bags 10 and 110 described above, the protective vest (shown in phantom in FIG. 18) used with carrying bag 210 is oriented at about a 90° angle to the carrying bag 210 when each are in use. In other words, when the protective vest is deployed on a person using the personal protective device shown in FIGS. 17-20, the carrying bag 210 will be oriented sideways and not in the upright position in which carrying bag 210 would normally be carried by a wearer using the shoulder strap 214.

FIG. 18 shows the position of slots 220 and 221 for torso straps 250 and 240, respectively. Zipper 230 comprising a pull tab 232 for accessing neck sling 260 is also illustrated. FIG. 19 illustrates neck sling 260 withdrawn through zippered opening and torso straps 240 and 250 extended through their respective slots 221 and 220. As shown, the orientation of the protective vest would not be the same as the carrying bag 210 when each is in its orientation for use, i.e. when the vest is in the deployed configuration on a wearer and when the carrying bag is being carried in a normal carrying position. When the protective vest is deployed and worn by a user, the purse 210 will be oriented sideways providing easier access to items located within carrying bag 210 to the wearer.

In the version shown in FIGS. 17-20 and other versions of the personal protective devices which have two slots extending through the rear wall of the carrying bag, the distance between the slots is preferably at least 15 cm apart, more preferably at least 22 cm, and can be at least 30 cm. For example, the distance between the slots can be about 15-20 cm, about 12-15 cm or about 10-30 cm.

While the personal protective devices can have different shapes and sizes, the devices can be configured so that a single protective vest can be utilized with several different carrying bags. For example, the protective vest 70 illustrated in connection with the personal protective device shown in FIGS. 1-12 could be dimensioned to be used with the personal protective device shown in FIGS. 17-20.

In each of the illustrated embodiments, the neck sling and torso sling/cord are readily returnable to their stored and mostly concealed positions when desired. Each embodiment provides a carrying bag which generally appears to be a common bag but is quickly and easily convertible into a protective vest, e.g. a bullet-resistant vest, which can provide protection to the wearer under life threatening conditions. The neck sling is substantially and preferably entirely hidden within the carrying bag when the personal protective device is in the ready state and is substantially outside of the carrying bag when the personal protective device is in the deployed configuration. The torso strap(s) are positioned substantially within the carrying case when the personal protective device is in the ready state and are substantially outside of the carrying bag when the personal protective device is in the deployed configuration after being pulled through slots in the carrying case.

In the illustrated versions, the protective shield stays within the carrying bag during deployment. Therefore, except for the straps, the personal protective device retains the same shape of the carrying bag when reconfigured from the ready state to the deployed configuration.

In terms of size, the purses may be smaller than other known ballistic bags. For example, purses of some versions have a width of 16-25 cm and a height of 25-37 cm. Such small sizes are believed to be more preferred by some users of purses.

The various embodiments provide personal protective devices which can provide lifesaving protection while being small, simple in terms of both construction and everyday use, and easy to deploy relative to other ballistic protection devices.

The invention claimed is:

1. A personal protective device in the form of a carrying case which is deployable into a protective garment comprising:

a protective vest comprising:

at least one protective shield;

a neck sling connected to said protective shield;

a torso strap comprising a secured portion and a free portion, said secured portion connected to said protective shield at a first location;

a connector connected to said protective shield at a second location which is spaced from said first location, said connector engageable with said free portion to secure said torso strap around the torso of a wearer;

a carrying case comprising a plurality of sides, an interior comprising at least one storage compartment, and at least one handle;

said protective vest is selectively positionable substantially within said carrying case;

said carrying case comprising a first opening which passes through one of said plurality of sides from the interior of said carrying case to the exterior of said carrying case, said free portion of said first torso strap extends through said first opening and is disposed outside of said carrying case;

said carrying case comprising a second opening which passes through one of said plurality of sides from the interior of said carrying case to the exterior of said carrying case, said connector is disposed outside of said carrying case proximate said second opening;

said carrying case comprising a third opening providing access to the interior of said carrying case and positioned proximate said neck sling;

said protective device is reconfigurable from said carrying case in a ready state wherein said protective shield is substantially concealed within the interior of said carrying case into said protective garment where said protective shield is substantially secured to the wearer's torso.

2. A personal protective device according to claim 1 wherein said connector is connected to said protective vest with a second torso strap.

3. A personal protective device according to claim 1 wherein said first location is spaced at least 15 cm from said second location.

4. A personal protective device according to claim 1 further comprising a shield envelope which substantially encases said protective shield.

5. A personal protective device according to claim 4 wherein said torso strap is connected to said shield envelope.

6. A personal protective device according to claim 5 further comprising a second torso strap and wherein said second torso strap is connected to said shield envelope.

7. A personal protective device according to claim 6 wherein said protective shield is a penetration resistant shield.

8. A personal protective device according to claim 6 wherein said protective shield is a bullet resistant shield.

9. A personal protective device according to claim 4 wherein said torso strap is formed of a stretchable material.

10. A personal protective device according to claim 4 wherein said neck sling is formed of a stretchable material.

11. A personal protective device according to claim 1 wherein said protective shield is a penetration resistant shield.

12. A personal protective device according to claim 1 wherein said protective shield is a bullet resistant shield.

13. A personal protective device according to claim 1 wherein said carrying case is a briefcase.

14. A personal protective device according to claim 1 wherein said carrying case is a purse.

15. A personal protective device according to claim 1 wherein said carrying case is a tote bag.

16. A personal protective device according to claim 1 wherein said handle comprises a shoulder strap.

17. A personal protective device according to claim 1 wherein said handle is rigid.

18. A personal protective device according to claim 1 wherein said first opening and said second opening are dimensioned to permit passage of said free portion and said connector, respectively.

19. A personal protective device according to claim 1 wherein said handle is configured to orient said carrying case in a vertical orientation when the carrying case is carried by said handle and said protective shield is positioned substantially horizontally within said carrying case so said neck sling is positioned more forwardly or rearwardly than said connector.

20. A personal protective device in the form of a carrying case which is deployable into a protective garment comprising:

a protective vest comprising:

a shield envelope;

at least one protective shield disposed in said shield envelope;

a neck sling connected to said shield envelope;

a torso strap comprising a secured portion and a free portion, said secured portion connected to said shield envelope at a first location;

a connector connected to a said shield envelope at a second location which is spaced from said first location;

a carrying case comprising a plurality of sides, an interior comprising at least one storage compartment, a storage compartment opening through which articles are passed for storage and removal from said storage compartment, and at least one handle;

said shield envelope is selectively positionable substantially within said carrying case and selectively removable from said carrying case;

said carrying case comprising a first opening which passes through one of said plurality of sides from the interior of said carrying case to the exterior of said carrying case, said free portion of said torso strap extends through said first opening and is disposed outside of said carrying case;

said carrying case comprising a second opening which passes through one of said plurality of sides from the interior of said carrying case to the exterior of said carrying case, said connector is disposed proximate said second opening, outside of said carrying case;

said carrying case comprising a third opening providing access to the interior of said carrying case and positioned proximate said neck sling;

said protective device is reconfigurable from said carrying case in a ready state wherein said protective shield is substantially concealed within the interior of said carrying case into said protective garment where said protective shield is substantially secured to the wearer's torso.

21. A personal protective device according to claim 20 wherein said connector is connected to said shield envelope with a second torso strap.

22. A personal protective device according to claim 20 wherein said first location is spaced at least 15 cm from said second location.

23. A personal protective device according to claim 20 further comprising a second torso strap and wherein said second torso strap is connected to said shield envelope.

24. A personal protective device according to claim 20 wherein said protective shield is a penetration resistant shield.

25. A personal protective device according to claim 20 wherein said protective shield is a bullet resistant shield.

26. A personal protective device according to claim 20 wherein said carrying case is a purse.

27. A personal protective device according to claim 20 wherein said handle comprises a shoulder strap.

28. A personal protective device according to claim 20 wherein said handle is rigid.

29. A personal protective device according to claim 20 wherein said first opening and said second opening are dimensioned to permit passage of said free portion and said connector, respectively.

30. A personal protective device according to claim 20 wherein said handle is configured to orient said carrying case in a vertical orientation when the carrying case is carried by said handle and said protective shield is positioned substantially horizontally within said carrying case so said neck sling is positioned more forwardly or rearwardly than said connector.

* * * * *